US009034553B2

(12) United States Patent
Hiramoto et al.

(10) Patent No.: US 9,034,553 B2
(45) **Date of Patent: *May 19, 2015**

(54) METHOD OF FOIL TRANSFER EMPLOYING FOIL TRANSFERRING FACE FORMING TONER AND IMAGE FORMING METHOD

(75) Inventors: Ryuichi Hiramoto, Tokyo (JP); Takao Yamanouchi, Kanagawa (JP); Kazue Nakamura, Tokyo (JP); Michiyo Fujita, Tokyo (JP)

(73) Assignee: KONICA MINOLTA BUSINESS TECHNOLOGES, INC., Tokyo (JP)

( * ) Notice: Subject to any disclaimer, the term of this patent is extended or adjusted under 35 U.S.C. 154(b) by 224 days.

This patent is subject to a terminal disclaimer.

(21) Appl. No.: 13/049,252

(22) Filed: Mar. 16, 2011

(65) Prior Publication Data

US 2011/0229819 A1 Sep. 22, 2011

(30) Foreign Application Priority Data

Mar. 19, 2010 (JP) ..... 2010-063852

(51) Int. Cl.
*G03G 5/05* (2006.01)
*G03G 15/00* (2006.01)

(52) U.S. Cl.
CPC .. *G03G 15/6582* (2013.01); *G03G 2215/00493* (2013.01); *G03G 15/6591* (2013.01)

(58) Field of Classification Search
CPC .... G03G 9/08711; G03G 15/14; G03G 13/22
USPC ..... 430/123.5, 126, 109.3, 108.2, 124, 430/125.31, 125.5, 126.1
See application file for complete search history.

(56) References Cited

U.S. PATENT DOCUMENTS 4,599,293 A * 7/1986 Eckell et al. ..... 430/125.6
4,868,049 A * 9/1989 Nelson ..... 428/328

(Continued)

FOREIGN PATENT DOCUMENTS

CN 101373344 A 2/2009
EP 0191592 B1 * 10/1990 ..... G03G 8/00

(Continued)

OTHER PUBLICATIONS

Chinese Office Action, Application No. 201110063101.X, mailing date: Dec. 18, 2013 (1 page).

(Continued)

*Primary Examiner* — Peter Vajda
*Assistant Examiner* — Olatunji Godo
(74) *Attorney, Agent, or Firm* — Lucas & Mercanti, LLP

(57) ABSTRACT

A method of transferring a foil comprising: forming a foil transferring face on a photoreceptor employing a foil transferring face forming toner; transferring the foil transferring face onto a base substance, followed by fixing the foil transferring face; supplying a transfer foil having at least a foil and an adhesive layer on the base substance having the fixed foil transferring face, heating the transfer foil and the foil transferring face while the adhesive layer of the transfer foil is in contact with the foil transferring face to adhere the foil onto the foil transferring face; removing the transfer foil from the base substance while leaving the foil adhered onto the foil transferring face, wherein the foil transferring face forming toner comprises at least a binder resin, wherein the binder resin comprises a polymer formed by using a vinyl monomer comprising at least a carboxyl group.

6 Claims, 8 Drawing Sheets

(56) References Cited

U.S. PATENT DOCUMENTS

| | | | | |
|---|---|---|---|---|
| 6,605,174 | B1 * | 8/2003 | Landa et al. | 156/233 |
| 8,105,744 | B2 | 1/2012 | Matsumura | |
| 2005/0208410 | A1 * | 9/2005 | Sakata et al. | 430/109.1 |

FOREIGN PATENT DOCUMENTS

| | | | | |
|---|---|---|---|---|
| EP | 0921441 | A1 * | 12/1997 | G03G 7/00 |
| EP | 0977091 | A1 * | 2/2000 | G03G 9/09 |
| JP | 62-161181 | | 7/1987 | |
| JP | 1-200985 | | 8/1989 | |
| JP | 5-279608 | | 10/1993 | |
| JP | 8-164663 | | 6/1996 | |
| JP | 9-1995 | | 1/1997 | |
| JP | 09-216478 | | 8/1997 | |
| JP | 2002-244335 | | 8/2002 | |
| JP | 2004-74422 | | 3/2004 | |
| JP | 2007-157159 | | 6/2007 | |
| JP | 2009-90464 | | 4/2009 | |
| JP | 2010-018025 | | 1/2010 | |
| WO | WO 97/36049 | * | 10/1997 | |

OTHER PUBLICATIONS

English translation of Chinese Office Action, Application No. 201110063101.X, mailing date: Dec. 18, 2013 (5 page).

Japanese Office Action, Patent Application No. JP 2011-058646, date of drafting: May 29, 2014. Date Mailed: Jun. 3, 2014 (2 pages).

English translation of Japanese Office Action, Patent Application No. JP 2011-058646, date of drafting: May 29, 2014. Date Mailed: Jun. 3, 2014 (4 pages).

* cited by examiner

METHOD OF FOIL TRANSFER EMPLOYING FOIL TRANSFERRING FACE FORMING TONER AND IMAGE FORMING METHOD

This application is based on Japanese Patent Application No. 2010-063852 filed on Mar. 19, 2010, in Japanese Patent Office, the entire content of which is hereby incorporated by reference.

FIELD OF THE INVENTION

The present invention relates to a method of transferring a foil employing a toner for forming a foil transferring face (hereinafter, also referred to as a foil transferring face forming toner or simply as a toner) used for forming a layer, so called a foil transferring face, on which a foil is transferred, the layer being formed by providing the toner on a portion of a base substance where the foil is to be transferred.

BACKGROUND OF THE INVENTION

In the field of plastic molding such as cosmetic containers, bookbinding, or commercial printing, metallic appearance or an expensive look which cannot be expressed merely by common printing, has been given to a product by conducting a printing processing treatment called as foil stamping on the surface of the base substance, by which a character or a picture image formed with a gold, silver or colored foil is transferred onto the surface. By this foil stamping which is also called hot stamping, a foil is transferred using heat and pressure on various materials such as paper, plastics or leather. This method is one of the most suitable methods to achieve a metallic gloss. Specifically, in this method, a transfer material layer having a foil formed on a plastic support is brought in contact with a base substance, and, then, the foil contained in the transfer material layer is transferred to a base substance to form a foil by conducting thermo-compression using a metal press.

In a transfer foil used for the foil stamping, for example, a protective layer, a transfer material layer and an adhesive layer are provided on a release agent layer formed on a plastic support made of such as a polyester film, in which the transfer material layer is formed by vacuum evaporation or by using an ink. The technique to produce a transfer foil has been improved in accordance with the enlargement of the market of the transfer foil. For example, researches on a transfer foil having a protective layer containing an organic silicon compound and a reactive organic compound in view of improving the durability of a foil image, and on a transfer foil having an electron beam curable adhesive layer by which a stronger protective layer is formed by being irradiated with an electron beam after peeled from the support, have been brought forward (for example, refer to Patent Documents 1 and 2).

In recent years, a hologram is often attached on, for example, a cash card or a credit card in order to prevent falsification or alteration, or for the security of these cards. Such a hologram used for the prevention of falsification of a card has been formed mainly by employing a technique of foil transferring. Since many of these transfer images used for the prevention of falsification or for security of the cards contain a precise pattern, it is required to accurately transfer the image but not to cause a problem such as a burr or missing of the foil. In accordance with such a requirement, there has been examined a transfer foil by which, by incorporating a polymer liquid crystal material in a transfer layer, a precise-shaped label is accurately transferred without causing defects such as burrs or missing of the foil (for example, refer to Patent Documents 3).

On the other hand, in order to conduct foil transfer on a base substance with a simple process and to stably hold the transferred foil for a long time, advanced has been a technique to form a resin layer on the surface of a base substance and to provide a transfer foil on the resin layer, followed by conducting a heat treatment to carry out foil transfer. For example, there has been proposed a technique to form an ink layer on the base substance of a product using an emulsion ink in which a hot melt adhesive agent is dispersed and to provide a transfer foil on the ink layer, followed by conducting a heat treatment to carry out foil transfer (for example, refer to Patent Document 4).

Also, proposed has been a technique to form a resin layer on a base substance using a toner and to conduct foil transfer via a hot stamp technique using the resin layer as a binder. For example, there has been a technique to transfer a foil on a three dimensional image by forming a convexed image or a design image on a base substance using a toner and placing an adhesive layer of a transfer foil on the toner image surface, followed by heat-pressing with a roller (for example, refer to Patent Documents 5 and 6). Further, there has been a technique regarding a transfer foil having a toner image formed with a dry toner on a substrate, in which a picture image is formed in the toner layer using a printer, followed by transferring onto a base substance (for example, refer to Patent Document 7). The techniques given in these patent documents may enable to thermo-compress a transfer foil on the surface of a base substance without using a metal pressing member called a press. This means that these techniques have intended to improve working efficiency by reducing necessary time for the foil transferring.

However, the adhesion property between the toner layer formed on the base substance and the transfer foil has not been fully considered in each technique disclosed by the above mentioned patent documents. For example, the foil is sometimes transferred onto a portion other than the toner layer when the transfer foil is brought in contacted with the base substance, whereby the aesthetic appearance of the product is spoiled due to the foil adheres to a location other than a predetermined place. Also, there has been a durability problem in which the adhesive strength of the foil transferred onto a base substance is sometimes not fully obtained, whereby the aesthetic appearance of the product is spoiled due exfoliation of the foil only by a small force. Further, there has been a problem in a productive point of view in which, when foil transfer is conducted onto a base substance without using a press, the foil transfer of a prescribed shape cannot be stably carried out due to partial missing of the foil or a burr caused by insufficient affinity of the toner layer with the adhesive layer of the transfer foil.

PRIOR ART DOCUMENTS

Patent Documents

| | |
|---|---|
| Patent Document 1 | Japanese Patent Application Publication Open to Public Inspection (hereafter referred to as JP-A) No. 9-1995 |
| Patent Document 2 | JP-A No. 2007-157159 |
| Patent Document 3 | JP-A No. 2009-90464 |
| Patent Document 4 | JP-A No. 5-279608 |
| Patent Document 5 | JP-A No. 1-200985 |

-continued

| | |
|---|---|
| Patent Document 6 | JP-A No. 8-164663 |
| Patent Document 7 | JP-A No. 2004-74422 |

SUMMARY OF THE INVENTION

An object of the present invention is to provide a method of transferring a foil in which employed is a foil transferring face forming toner which enables assured transfer of a transfer foil onto a foil transferring face formed on a base substance with the toner, by which a foil is transferred onto a prescribed portion on the base substance without using a press to exhibit a strong adhesive force between the foil and the foil transferring face, whereby missing of the foil and burrs are avoided and an excellent aesthetic appearance is obtained.

One of the aspects to achieve the above object of the present invention is a method of transferring a foil comprising the steps of:

(1) exposing a photoreceptor to form an electrostatic latent image;

(2) supplying a foil transferring face forming toner to a photoreceptor having thereon the electrostatic latent image to form a foil transferring face on the photoreceptor;

(3) transferring the foil transferring face formed on the photoreceptor onto a base substance;

(4) fixing the foil transferring face on the base substance;

(5) supplying a transfer foil having at least a foil and an adhesive layer on the base substance having the fixed foil transferring face;

(6) bringing the adhesive layer of the transfer foil in contact with the foil transferring face;

(7) heating the transfer foil and the foil transferring face while the adhesive layer of the transfer foil is in contact with the foil transferring face to adhere the foil onto the foil transferring face; and (8) removing the transfer foil from the base substance while leaving the foil adhered onto the foil transferring face, wherein the foil transferring face forming toner comprises at least a binder resin, wherein the binder resin comprises a polymer formed by using a vinyl monomer comprising at least a carboxyl group.

DESCRIPTION OF THE PREFERRED EMBODIMENTS

Figure 1A:
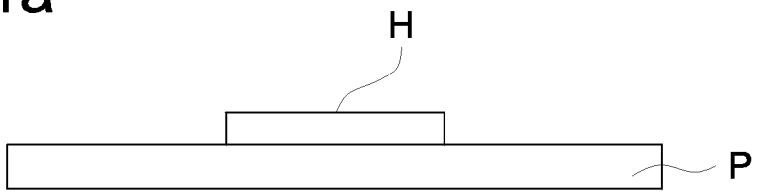
FIGS. 1*a* to 1*c* are schematic diagrams showing a procedure to transfer a foil on a foil transferring face formed on a base substance.

The above object of the present invention is achieved by the following structures.

1. A method of transferring a foil comprising the steps of:

(1) exposing a photoreceptor to form an electrostatic latent image;

(2) supplying a foil transferring face forming toner to a photoreceptor having thereon the electrostatic latent image to form a foil transferring face on the photoreceptor;

(3) transferring the foil transferring face formed on the photoreceptor onto a base substance;

(4) fixing the foil transferring face on the base substance;

(5) supplying a transfer foil having at least a foil and an adhesive layer on the base substance having the fixed foil transferring face;

(6) bringing the adhesive layer of the transfer foil in contact with the foil transferring face;

(7) heating the transfer foil and the foil transferring face while the adhesive layer of the transfer foil is in contact with the foil transferring face to adhere the foil onto the foil transferring face; and (8) removing the transfer foil from the base substance while leaving the foil adhered onto the foil transferring face, wherein the foil transferring face forming toner comprises at least a binder resin, wherein the binder resin comprises a polymer formed by using a vinyl monomer comprising at least a carboxyl group.

2. The method of Item 1, wherein a content of the carboxyl group comprised in the binder resin is $5.0\times10^{-7}$ mol/g to $5.0\times10^{-5}$ mol/g based on a mass of the binder resin.

3. The method of Item 2, wherein the content of the carboxyl group comprised in the binder resin is $5.0\times10^{-6}$ mol/g to $5.0\times10^{-5}$ mol/g based on a mass of the binder resin.

4. The method of any one of Items 1 to 3, wherein the binder resin comprises a polymer prepared by using at least a methacrylic acid.

5. The method of any one of Items 1 to 4 wherein an amount of the foil transferring face forming toner fixed on the base substance is 2.0 to 12.0 g/m$^2$.

6. The method of any one of Items 1 to 5, wherein the step (7) is carried out using a heat roller and a pressure roller, wherein a contact face pressure obtained by using the heat roller and the pressure roller is 200 to 600 kPa.

7. A method of forming an image comprising the steps of:

preparing a base substance provided with a foil having an image, the foil having the image being transferred according to the method of any one of Items 1 to 6; and forming an visible image using a toner according to an electrophotographic method on the base substance provided with the foil having the image to manufacture a product having both the foil having the image and the visible image.

On the foil transferring face formed by using the foil transferring face forming toner of the present invention, foil transfer onto a foil transferring face can be surely conducted since a moderate adhesive force between an adhesive layer constituting the transfer foil and the foil transferring face can be obtained. Namely, foil transfer to a predetermined portion on a base substance can be stably performed. Since a strong adhesive force of the foil transferred onto a base substance can be obtained, even when a force is added to the foil formed on the base substance, the foil is never exfoliated, whereby an excellent aesthetic appearance of the product having the transferred foil has come to be maintained. Further, when the foil transferring face forming toner of the present invention is employed, foil transfer can be carried out without using a press and a foil can be transferred onto a prescribed portion on the base substance with an excellent accuracy without causing missing of the foil or burrs.

Further, regarding the foil transferring face forming toner of the present invention, an excellent adhesion property between the foil transferring face formed by using said toner and the transfer foil can be obtained by controlling the amount of carboxyl groups in the binder resin of the toner within a prescribed range. As the result, it has become possible to accurately transfer a transfer foil having a prescribed shape onto a prescribed portion on a base substance without using a press since the transfer foil is strongly adhered onto the foil transferring face formed by using said toner, when the transfer foil is brought in contact with the base substance.

Therefore, since a complicated design containing plenty of thin lines can be formed via a simple method, it has become possible to notably improve the aesthetic appearance of a product. Further, it is possible to expand the application of the method to the formation of a hologram image which has a complicated shape and can record personal information in card business such as an identification certificate. Accordingly, this method can also contribute to production of ID cards containing much information.

The present invention relates to a method of transferring a foil employing a foil transferring face forming toner (hereinafter, also referred to simply as a toner) used for forming a layer, so called a foil transferring face, on which a foil is transferred to improve the aesthetic appearance of the product, the layer being formed on a portion of a base substance where the foil is to be transferred by providing the toner.

It was found by the present inventors that, when a foil transferring face forming toner having a binder resin containing a polymer formed by using a vinyl monomer having at least a carboxyl group (—COOH) is used, a foil formed on a base substance can be firmly held without peeling. Further, it was found that, when a foil is transferred, the foil having a prescribed shape and causing few missing of the foil or burrs can be surely transferred onto the base substance without using a press.

The present invention will now be described in detail.

The "foil transferring face forming toner" as mentioned in the present invention refers to a resin powder used for forming a portion on which a foil is formed, when a foil is formed on a base substance of an image support to form an image or of a plastic molding, for example, an ID card. The foil transferring face forming toner is used to improve or maintain the adhesive property of a transfer foil on the base substance through a toner layer formed on the base substance. Specifically, at first, the toner of the present invention is supplied to a photoreceptor on which an electrostatic latent image is formed, the electrostatic latent image having the same shape as the shape of foil which is to be formed on a base substance, whereby a toner layer (a foil transferring face) for transferring a foil on the base substance is formed. The toner layer formed on the photoreceptor is transferred onto a base substance, followed by conducting a fixing treatment by heating. Next, a transfer foil is supplied onto the base substance having the fixed toner layer to adhere a foil on the toner layer by conducting a heat treatment while the transfer foil is in contact with the base substance. And, when the toner foil is removed while leaving a portion adhered onto the foil transferring face, a foil is transferred on the toner layer, whereby a pattern of a foil is formed on a base substance.

As described above, "the foil transferring face forming toner" as mentioned in the present invention is used to be supplied to a photoreceptor to form a toner layer called as "a foil transferring face". The foil transferring face formed with the foil transferring face forming toner of the present invention on the photoreceptor is then transferred onto a sheet like base substance, typically an image support, followed by fixing. Further, when a transfer foil is supplied on the foil transferring face fixed on the base substance and then heated, the foil is firmly adhered onto the foil transferring face. Thus, foil transfer is carried out. The amount of the foil transferring face forming toner fixed on the base substance is preferably 2.0 to 12.0 g/m$^2$.

"The foil transferring face" as mentioned in the present invention is an area on a base substance such as an image support or a plastic molding, on which a foil is transferred.

In the present invention, the terms "product" and "base substance" are used. Either of them is constituted of a support called an image support on which image forming via a well-known image forming method is capable. Here, the "product" as mentioned in the present invention refers to a support decorated with a foil formed by at least transferring a foil on a base substance, and the "base substance" as mentioned in the present invention refers to an image support constituted of a base material such as paper or PET (polyethylene terephthalate) or a substance having a three-dimensional shape, for example, a plastic molding, which is before decorated by a foil.

Furthermore, the "foil" as mentioned in the present invention, refers to a material obtained by rolling a metal into a thin film to be capable of adhering onto a base substance, which is used to provide a text image or a picture image having a metallic or glossy appearance which is difficult to be provided via a normal printing. The "transfer foil" as described in the present invention contains at least a foil and an adhesive layer and is supplied on a base substance when the foil is transferred onto the base substrate.

The foil transferring face forming toner will now be explained. The binder resin constituting the toner of the present invention contains a polymer obtained by using a vinyl monomer having at least a carboxyl group (—COOH). The toner of the present invention is used, for example, to firmly hold, on a base substance, a foil used to improve the aesthetic appearance of a product, for example, an image support on which an image is formed or, a plastic molding.

Specifically, said toner is supplied to an area on a photoreceptor, where an electrostatic latent image is preliminarily formed, to form a toner layer having a shape corresponding to the shape of the electrostatic latent image. The toner layer formed on the photoreceptor is transferred onto a base substance, and a transfer foil is then brought in close contact with said toner layer. When the transfer foil and the toner layer are heated, a foil having the shape of the toner layer is transferred from the transfer foil, while the toner layer is melted to be fixed on the base substance. Thus, it is possible to firmly and precisely transfer a foil onto the base substance.

The foil transferring face forming toner of the present invention contains at least a binder resin, and the binder resin contains a polymer formed by using a vinyl monomer having at least a carboxyl group. It was found by the present inventors that a strong adhesive force between the toner layer and the adhesive layer contained in the transfer foil is obtained by incorporating the aforementioned polymer in the binder resin constituting the toner. It is considered that the aforementioned improved adhesive force between the toner layer and the adhesive layer would be the result of an intermolecular force due to a van der Waals force or a hydrogen bond via a water molecule existing in air between the toner layer and the adhesive layer, these forces being considered to be caused by an effect of the moderate polarity provided in the toner layer by the existence of carboxyl groups contained in the polymer.

Specific examples of the polymerizable monomer containing a carboxyl group (—COOH) for forming the foil transferring face forming toner according to the invention include a vinyl monomer containing a carboxylic group. Specific examples of the a vinyl monomer containing a carboxyl group (—COOH) include, at first, a compound containing one carboxylic group in the molecule structure, such as acrylic acid and methacrylic acid. Examples of a vinyl monomer containing two carboxyl groups include itaconic acid, maleic acid and fumaric acid, and examples of a vinyl monomer containing three carboxyl groups include aconitic acid. Specific examples of a vinyl monomer containing a carboxylic group (—COOH) are listed below. The vinyl monomer containing a carboxylic group usable in the present invention is not limited to those mentioned above or listed below.

(1)

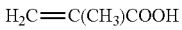

Methacrylic acid (2)

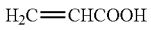

Acrylic acid (3)

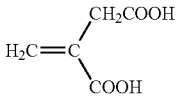

Itaconic acid (4)

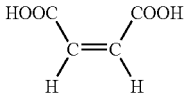

Maleic acid (5)

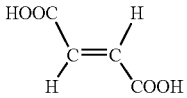

Fumaric acid (6)

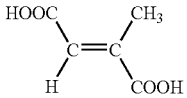

Mesaconic acid (7)

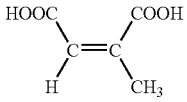

Citraconic acid (8)

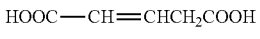

2-Pentene diacid (9)

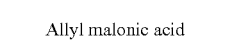

Allyl malonic acid

-continued (10)

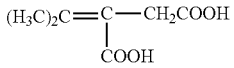

Isopropylidene succinic acid (11)

2,4-Hexadiene diacid (12)

Acetylene dicarboxylic acid (13)

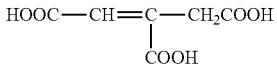

Aconitic acid

The binder resin constituting the foil transferring face forming toner of the present invention contains, as aforementioned, a polymer formed by using a vinyl monomer containing at least a carboxyl group (—COOH), accordingly, the binder resin contains a carboxyl group. In the present invention, it is preferable that the binder resin contains $5.0\times10^{-7}$ mol/g or more but $5.0\times10^{-5}$ mol/g or less, and, more preferably, $5.0\times10^{-6}$ mol/g or more but $5.0\times10^{-5}$ mol/g or less of carboxyl group based on the mass of the binder resin.

The aforementioned polymer formed by using a vinyl monomer containing a carboxyl group (—COOH) is preferably a polymer formed by using at least methacrylic acid. Specifically, the polymer is more preferably formed by using a vinyl monomer which has two or more carboxyl groups, for example, itaconic acid or aconitic, in addition to methacrylic acid.

In the present invention, when foil transfer is carried out while forming a foil transferring face using a toner of which content of the carboxyl group in the binder resin is with in the above described range, a foil can be accurately transferred along the shape of the foil transferring face without using a jig such as a press on a base substance. Therefore, a complicated design such as one containing plenty of thin lines can be accurately reproduced using a foil. Such a complicated design has been suffered from missing of the foil or occurrence of burrs in the conventional techniques. Further, even a design, of which contact area is difficult to keep, such as a thin line, exhibits a strong adhesive force after transferred on a product, whereby the design is free from peeling. Thus, by controlling the content of carboxyl groups in the binder resin forming the toner of the present invention within the aforementioned range, a design having a complicated shape can be accurately formed without missing of the foil and burrs, and such a design can be surely maintained on a product. Accordingly, the present method is specifically suitable for forming a hologram which is used for an identification card to record personal information as well as to provide a high-grade aesthetic appearance.

The content of carboxyl groups in the binder resin can be determined by a well-known method. Specifically, the content of carboxyl groups can be determined by: dispersing toner particles, for example, in ion exchanged water to obtain a dispersion liquid; titrating the dispersion liquid by adding an alkaline aqueous solution such as an aqueous sodium hydroxide solution by using a well-known conductometric titration apparatus.

For example, the measurement procedure of the carboxyl group content in the binder resin is as follows:

(1) sampling 2.50 g (in solid content) of a toner particle dispersion liquid or a binder resin dispersion liquid in a beaker;

(2) titrating the above dispersion liquid by adding 0.01 mol/l. aqueous sodium hydroxide solution using a commercial conductometric titration apparatus to find the neutralization point of the carboxyl group, wherein, for example, "ABU91 Autoburett and CDM80 Conductivity meter (product by Radiometer Co., Ltd) is usable as a conductometric titration apparatus;

(3) determining the neutralization point due to the carboxyl groups by finding an inflexion point from the obtained titration curve, wherein there are two inflexion points according to the neutralization of sulfonic acid and the neutralization of the carboxyl group, and the second inflexion point corresponds to the neutralization of the carboxyl groups;

(4) calculating the total amount of the carboxyl groups Mt contained in the above dispersion liquid according to the following equation, provided that Y1 and Y2 represent the amounts of the aqueous sodium hydroxide solution (in ml) consumed before arriving at the neutralization points due to the sulfonic acid and the carboxyl group, respectively, $$\text{Total amount of carboxyl groups } Mt = 0.01 \times (Y2 - Y1) \times 10^{-3} \text{(mole)};$$

(5) calculating the amount of the carboxyl groups per unit mass by dividing the total amount of carboxyl groups Mt with the mass of the particles used in the titration, namely, $$\text{Amount of carboxyl groups} = Mt/2.5 \text{(mole/g)}$$

Thus, the content of the carboxyl groups in the binder resin constituting the foil transferring face forming toner of the present invention can be determined according to the above procedure.

In the preparation of a binder resin constituting the aforementioned toner, in the present invention, a vinyl monomer which does not contain a carboxyl group, which will be described later, may also be used together with the aforementioned vinyl monomer containing a carboxyl group (—COOH). The vinyl monomer which can be used together with "the vinyl monomer which has a carboxyl group (—COOH)" is not specifically limited, and vinyl monomers well-known in the art are usable, specific examples of which will be described below.

Specific examples of a vinyl monomer usable together with the aforementioned vinyl monomer having a carboxyl group will be listed below. However, a vinyl monomer usable for preparing the binder resin constituting the toner of the present invention is not limited to those listed below.

(1) Styrene and its Derivatives

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene.

(2) Methacrylate Derivatives

Methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate.

(3) Acrylate Derivatives

Methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate.

(4) Olefins

Ethylene, propylene and isobutylene.

(5) Vinyl Esters

Vinyl propionate, vinyl acetate and vinyl benzoate.

(6) Vinyl Ethers

Vinyl methyl ether and vinyl ethyl ether.

(7) Vinyl Ketones

Vinyl methyl ketone, vinyl ethyl ketone and vinyl hexyl ketone.

(8) N-vinyl Compounds

N-vinylcarbazole, N-vinylindole and N-vinylpyrrolidone.

(9) Others

Vinyl compounds such as vinylnaphthalene and vinylpyridine, acrylic or methacrylic derivatives such as acrylonitrile, methacrylonitrile and acrylamide.

Further, it is also possible to prepare resins having a cross-linking structure, employing polyfunctional vinyls which will be listed below, namely, for example, divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate and neopentyl glycol diacrylate.

The molecular weight of the resin listed above is not specifically limited as far as it is possible to form a toner layer exhibiting a strong adhesive force between the adhesive layer of the foil, however, the number average molecular weight Mn is preferably 5,000 to 50,000. One of the preferable examples is that having Mw/Mn, a ratio of weight average molecular weight Mw to number average molecular weight Mn of 1.0 to 1.5. A sharp melting performance is exhibited at the fixing process when the number average molecular weight Mn and weight average molecular weight Mw of the resin composing the toner of the present invention meet the relationship described above, and this is expected to achieve a quick foil transfer.

Further, the foil transferring face forming toner of the present invention may be added with a commonly known wax. Examples of a usable wax include the following compounds.

(1) Hydrocarbon Wax:

polyolefin wax such as paraffin wax, polyethylene wax and polypropylene wax, and sazole wax;

(2) Ester Wax:

trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol stearate, trimellitic acid tristearate and distearyl maleate;

(3) Amide Wax:

ethylenediamine dibehenylamide and trimellitic acid tristearylamide;

(4) Dialkyl Ketone Wax:

distearyl wax;

(5) Other Wax:

Carnauba wax and montan wax.

As examples of an above mentioned hydrocarbon wax, for example, a linear hydrocarbon compound, a branched-chain hydrocarbon compound and a hydrocarbon compound having a cyclic structure in the molecule may be cited, in terms of the molecular structure.

Examples of a linear-hydrocarbon compound include a petroleum wax such as paraffin wax containing a normal paraffin as a main component and a polyolefin wax such as Fischer-Tropsch wax, polyethylene wax and polypropylene wax. Here, the paraffin wax is a wax separated from a reduced pressure distillated oil via a well-known method. The Fischer-Tropsch wax is a hydrocarbon compound having from 16 to 78 carbon atoms obtained from distillation of a hydrocarbon compound synthesized from synthetic gas composed of carbon monoxide and hydrogen, or a hydrogenation product thereof. The polyethylene or polypropylene wax is a wax synthesized by polymerization of ethylene or propylene, or thermal decomposition of polyethylene or polypropylene.

As examples of a branched-chain hydrocarbon compound and a hydrocarbon compound having a cyclic structure in the molecule, the following microcrystalline waxes and waxes having isoparaffin as a main component may be cited. Examples of a microcrystalline wax include: HNP-0190, Hi-Mic-1045, Hi-Mic-1070, Hi-Mic-1080, Hi-Mic-1090, Hi-Mic-2045, Hi-Mic2065 and Hi-Mic-2095, all produced by Nippon Seiro Co., Ltd. "Microcrystalline waxes", as described herein, refer to those in which the ratio of a branched-chain hydrocarbon (referred to as an isoparaffin) and a cyclic hydrocarbon (referred to as a cycloparaffin) is greater. Generally, since a microcrystalline wax incorporates a large amount of low crystalline isoparaffin and cycloparaffin, crystals are smaller than those of a paraffin wax, while the molecular weight thereof is greater than that of a paraffin wax. The number of carbon atoms, the number average molecular weight Mn, and the melting point of the aforesaid microcrystalline wax are 60-150, 900-2000, and 60-90° C., respectively.

Specific examples of a wax having isoparaffin as a main component include EMW-0001 and EMW-0003.

The reason why a strong adhesive force of the foil against the base substance is provided and a foil having a prescribed shape can be accurately transferred without missing of the foil and burrs is deduced to be due to the following effects.

The reason is considered to be because a strong adhesive force between the foil and the toner layer of the foil transferring face is obtained by the effect of the polarity due to the carboxyl group contained in the polymer contained in the binder resin, where the polymer is formed using a vinyl monomer having a carboxyl group (—COOH). Namely, the adhesive force has been improved as the result of the enhanced inter molecular force due to a van der Waals force, or a hydrogen bond via a water molecule existing in air, between the toner layer and the adhesive layer, caused by the effect of the polarity of the carboxyl groups existing on the surface of the toner layer.

Therefore, the transfer foil can be peeled while transferring a foil along the shape of the toner layer, whereby an image of a foil can be surely formed in the predetermined portion of a base substance with the prescribed shape without causing missing of the foil and burrs. Also, since a strong adhesive force between the toner layer and the foil can be obtained, the image of the foil becomes difficult to be peeled, whereby the aesthetic appearance of the product can be maintained.

Next, the method of manufacturing the foil transferring face forming toner of the present invention will be described.

The foil transferring face forming toner contains a binder resin containing a polymer formed by using a polymerizable monomer containing at least a carboxyl group (—COOH). A manufacturing method of particles composing the toner of the present invention is not particularly limited, and known manufacturing method of toners used in the electrophotographic image forming can be applied. That is, such a method can be applied as so called a pulverization method in which toner is manufactured via processes of kneading, pulverization and classification, and so called a polymerization method in which particles are formed by polymerization of a polymerizable monomer and simultaneously controlling the shape or particle size.

The toner manufactured by the polymerization method is said to be easy to obtain properties such as uniform particle size distribution, uniform shape distribution and sharp charge distribution among them. The manufacturing method by polymerization method has a process to form resin particles by polymerization reaction such as suspension polymerization and emulsion polymerization. It is particularly preferable to manufacture via association process in which resin particles manufactured by polymerization are subjected to coagulation and fusion to form particles.

A manufacturing method of the toner of the present invention by emulsion association method will be described as an example. The manufacturing method of the toner by emulsion association method is conducted, for example, by the following processes.

(1) Process of preparation of dispersion liquid of resin particles (2) Process of coagulation and fusion of the resin particles (3) Process of ripening (4) Process of cooling (5) Process of washing (6) Process of drying (7) Process of adding an external additive Each process will be described.

(1) Process of Preparation of Dispersion Liquid of Resin Particles

This is a process to form a resin composing the toner. Concretely, a polymerizable monomer mixture composition such as the above mentioned polymerizable monomer containing a carboxyl group (—COOH) is dispersed in an aqueous medium, and polymerization is conducted under this state to form particles in an embodiment.

Resin particles are formed by adding the above mentioned polymerizable monomer having a carboxyl group (—COOH) in an aqueous medium and so on, and after that emulsion dispersing it to form oil droplets of the polymerizable monomer mixture composition. Then the resin particles are formed by conducting radical polymerization reaction inside of the oil droplets dispersed in the aqueous medium in this process.

The radical polymerization reaction is a process wherein a polymerization initiator is incorporated inside of the above mentioned oil droplets to generate radicals, polymerization reaction of the polymerizable monomer forming the oil droplets is initiated, and resin is formed by the polymerization reaction. Polymerization reaction can be initiated by supplying radicals generated from the polymerization initiator added in the aqueous medium into oil droplets by known method in other way.

Temperature during the radical polymerization depends on the species of a polymerizable monomer including the polymerizable monomer having a carboxyl group and an initiator generating radicals, and usually is preferably 50 to 100° C., and more preferably 55 to 90° C. The reaction time, which depends on reaction rate of polymerizable monomer used in the polymerization reaction or generated radicals, is preferably 2 to 12 hours.

Oil droplets of the monomers are formed by that the styrene monomer, acrylic acid ester monomer, polycarboxylic acid and polyalcohol are added and dispersed in an aqueous medium and these are subjected to dispersion process via an activity of mechanical energy. Dispersion apparatus in which oil droplets dispersion is carried out via application of mechanical energy are not particularly limited, but examples thereof include "CLEARMIX", ultrasonic homogenizers, mechanical homogenizers, Manton-Gaulin, and pressure system homogenizers. Further, the dispersed particle diameter of the polymerizable monomer solution is preferably about 100 nm.

The aqueous medium refers to a medium containing water in an amount of at least 50% by mass. As components other than water are cited water-soluble organic solvents and examples thereof include methanol, ethanol, isopropanol, butanol, acetone, methyl ethyl ketone and tetrahydrofuran. Of these solvents, it is preferred to use organic solvents which do not dissolve a resin, for example, alcoholic solvents such as methanol, ethanol, isopropanol and butanol.

(2) Process of Coagulation and Fusion of the Resin Particles (Association Process)

This is a process to form particles by coagulating resin particles formed by the above described process and to form mother particles for toner having no external additives by fusing the coagulated particles, the process being referred to an association process. Particles are manufactured by coagulating and fusing the resin particles formed by polymerizing polymerizable monomer having a carboxylic acid group and other polymerizable monomer.

In this step, a coagulant of an alkali metal salt or an alkaline earth metal salt such as magnesium chloride is added to an aqueous medium containing resin particles to coagulate these particles. Subsequently, the aqueous medium is heated at a temperature higher than the glass transition temperature of the resin particles to allow coagulation to proceed and to allow coagulated resin particles to fuse. When allowing coagulation to proceed and reach the targeted particle size, a salt such as sodium chloride is added to stop coagulation.

(3) Ripening:

Ripening is a step of shape controlling step following the coagulation and fusing step, and a system including coagulated particles is stirred with heating, until the shape of toner particles reaches the intended average circularity.

(4) Cooling:

This step refers to a stage that subjects a dispersion of the foregoing toner particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

(5) Washing:

In the washing step, a solid-liquid separation treatment of separating toner particles from a toner particle dispersion is conducted, then cooled to the prescribed temperature in the foregoing step and a washing treatment for removing adhered material such as a surfactant or salting-out agent from a separated toner particles (aggregate in a cake form) is applied.

In this step, washing is conducted until the filtrate reaches a conductivity of 10 μS/cm. A filtration treatment is conducted, for example, by a centrifugal separation, filtration under reduced pressure using a Buchner's funnel or filtration using a filter press, but the treatment is not specifically limited.

(6) Drying:

In this step, the washed toner cake is subjected to a drying treatment to obtain dried colored particles. Drying machines usable in this step include, for example, a spray dryer, a vacuum freeze-drying machine, or a vacuum dryer. A standing plate type dryer, a movable plate type dryer, a fluidized-bed dryer, a rotary dryer or a stirring dryer is preferably used.

The moisture content of the dried toner particles is preferably not more than 5% by mass, and more preferably not more than 2% by mass. When toner particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

(7) External Additive Addition:

In this external additive treatment step, external additives or a lubricant is added to dried toner mother particles. Toner mother particles which were subjected to the drying step may be used as toner particles, but addition of external additives can enhance the electrostatic-charging property, fluidity and cleaning property. External additives usable in the present invention include, for example, organic or inorganic particles and aliphatic metal salts. An external additive is added preferably in an amount of 0.1 to 10.0% by mass, and more preferably 0.5 to 4.0% by mass. A variety of additives may be combined. Examples of a mixing device, used to add external additives include a tabular mixer, a HENSCHEL MIXER, a NAUTA Mixer, a V-type mixer and a coffee mill.

Inorganic particles may be employed. Specifically, it is possible to preferably employ minute silica, titanium, and alumina particles and the like. These minute inorganic particles subjected to hydrophobic processing may be used.

Specifically listed as silica particles, for example, are commercially available R-805, R-976. R-974, R-972, R-812, and R-809, produced by Nippon Aerosil Co. Ltd.; HVK-2150 and H-200, produced by Hoechst AG: commercially available TS-720, TS-530, TS-610, H-5, and MS-5, produced by Cabot Corp; and the like.

Listed as titanium particles, for example, are commercially available T-805 and T-604, produced by Nippon Aerosil Co.; commercially available MT-100S, MT-10013, MT-500BS, MT-600, MT-600SS and KA-1, produced by TAYCA CORPORATION; commercially available TA-300SI, TA-500, TAF-130, TAF-510 and TAF-510T, produced by Fuji Titanium Industry Co., Ltd.; commercially available IT-S, IT-OA, IT-OB and IT-OC, produced by Idemitsu Kosan Co.; and the like.

Listed as alumina particles, for example, are commercially available RFY-C and C-604, produced by Nippon Aerosil Co., commercially available ITO-55, produced by ISHIHARA SANGYO KAISHA, LTD., and the like.

Further, employed as fine organic particles are fine spherical organic particles having a number average primary particle diameter of 10 to 2,000 nm. Employed as such particles may be homopolymers or copolymers of styrene or methyl methacrylate.

The foil transferring face forming toner according to the present invention can be manufactured via emulsion association process through the steps described above.

Polymerization initiator, dispersion stabilizer, surfactant and the like which can be used in the emulsion association method manufacturing the toner according to the present invention will be described.

A binding resin composing the toner according to the present invention is formed by employing a polymerizable monomer having a carboxyl group on a side chain as described above, and oil soluble or water soluble polymerization initiator can be used Practical example of the oil soluble initiator includes azo type and diazo type polymerization initiators and a peroxide initiator described below.

(1) Azo Based or Diazo Based Polymerization Initiators;

2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, (2) Peroxide Based Polymerization Initiators;

benzoyl peroxide, methyl ethyl ketone peroxide, diisopropylperoxy dicarbonate, cumenehydroperoxide, t-butylhydroperoxide, di-t-butyl peroxide, dicumyl peroxide, 2,4-dichlorobenzoyl peroxide, lauroyl peroxide, 2,2-bis-(4,4-di-t-butylperoxycyclohexyl)propane, and tris-(t-butylperoxy) triazine.

Water soluble radical polymerization initiator can be used when the resin particles are formed by an emulsion polymerization method. The water soluble radical polymerization initiator includes a persulfate salt such as potassium persulfate or ammonium persulfate; azobisaminodipropane acetic acid salts; azobiscyanovaleric acid and salts thereof; and hydrogen peroxide.

In this polymerization step, conventionally used chain transfer agents can be employed in order to regulate the molecular weight of the targeted core forming binder resin. A chain transfer agent used for the present invention is not specifically limited. Examples of a chain transfer agent, include: a mercaptan such as n-octylmercaptan n-decylmercaptan, or tert-dodecylmercaptan; a mercaptopropionic acid ester such as n-octyl-3-mercaptopropionic acid ester; terpinolene; and α-methylstyrene dimer.

The toner is manufactured by polymerizing vinyl type monomers including polymerizable monomer containing carboxyl group described above in a state of aqueous dispersion, then dispersing the prepared resin particles, which are coagulated and fused to manufacture the toner. It is preferable to use dispersion stabilizers so as to disperse these toner raw material stably in aqueous medium. Examples of dispersion stabilizers include tricalcium phosphate, magnesium phosphate, zinc phosphate, aluminum phosphate, calcium carbonate, magnesium carbonate, calcium hydrate, magnesium hydrate, aluminum hydrate, calcium metasilicate, calcium sulfate, barium sulfate, bentonite, silica and alumina. Further, polyvinyl alcohol, gelatin, methylcellulose, sodium dodecylbenzene sulfate, an ethyleneoxide adduct and high alcohol sodium sulfate, which are commonly usable as surfactants, can also be utilized as dispersion stabilizers.

It is necessary to disperse the oil droplets of the polymerizable monomer described above in an aqueous medium stably using a surfactant when the polymerization is conducted employing the polymerizable monomers in the aqueous medium. Surface active agents include sulfonic acid salts such as sodium dodecylbenzenesulfonate, sodium arylalkylpolyethersulfonate, sodium 3,3-disulfondiphenylurea-4,4-diazo-bis-amino-8-naphthol-6-sulfonate, ortho-carboxybenzene-azo-dimethylaniline, sodium 2,2,5,5-tetramethyltriphenylmethane-4,4-diazo-bis-β-naphthol-6-sulfonate, etc.

Sulfonic ester salts includes sodium tetradecylsulfate, sodium pentadecylsulfate, sodium octylsulfate, etc., fatty acid salts such as sodium oleate, sodium laurate, sodium caprate, sodium caprylate, sodium caproate, potassium stearate, calcium oleate, etc.

Further, nonionic surfactant also may be employed. Examples are mentioned as polyethyleneoxide, polypropyleneoxide, combination of polypropyleneoxide and polyethyleneoxide, ester of polyethyleneglycol and higher tatty acid, alkylphenol polyethyleneoxide, ester of higher fatty acid and polyethylene glycol, ester of higher fatty acid and polypropyleneoxide, sorbitan ester.

Next, a method of foil transfer employing the foil transferring face forming toner of the present invention (hereafter also referred to as a method of foil transfer of the present invention) will be explained. The method of foil transfer of the present invention contains at least the following steps (1) to (8). Namely, (1) the step of exposing a photoreceptor to form an electrostatic latent image, (2) the step of forming a foil transferring face by supplying a foil transferring face forming toner of the present invention to the photoreceptor on which the electrostatic latent image is formed, (3) the step of transferring the foil transferring face formed on the photoreceptor onto a base substance, (4) the step of fixing the foil transferring face transferred on the base substance by heating, (5) the step of supplying a transfer foil having at least an adhesive layer on the base substance having the fixed foil transferring face, (6) the step of bringing the adhesive layer of the supplied transfer foil in contact with the base substance, (7) the step of heating the transfer foil and the foil transferring face while the adhesive layer of the transfer foil is in contact with the foil transferring face, and (8) the step of peeling the transfer foil from the base substance while leaving a portion of the transfer foil adhered on the foil transferring face.

Thus, in the method of foil transfer of the present invention, at first, a photoreceptor is exposed to form an electrostatic latent image having the shape of the foil transferring face to be formed on the product and the foil transferring face forming toner of the present invention is supplied to the photoreceptor on which the electrostatic latent image is formed, whereby a foil transferring face is formed. The foil transferring face formed on the photoreceptor is transferred onto a base substance, and a transfer foil is supplied onto the base substance having the foil transferring face which is fixed by heating to be in contact with the base substance. Under this state, the transfer foil and foil transferring face are heated to transfer the foil onto the foil transferring face.

As mentioned above, in the present invention, it has become possible to carry out foil transfer with high precision without using a press while avoiding missing of the foil and burrs by employing a toner containing a binder resin obtained by using a polymer formed with a vinyl monomer having at least a carboxyl group (—COOH), whereby it has become possible to conduct transfer of a foil having a design of a thin line image of which contact area is difficult to keep. Such foil transfer had been difficult in conventional techniques. Further, even when such a design of a thin line image of which the contact area is difficult to keep is transferred on a base substance, the transferred foil is hardly peeled due to the strong adhesive force, whereby loss of aesthetic appearance of the product due to peeling of the foil tends not occur.

The method of foil transfer of the present invention will be specifically described using figures. FIGS. 1*a* to 1*c* and FIGS. 2*a* and 2*b* are schematic figures illustrating the procedure of the foil transfer method containing the steps (5)-(8) among the above steps (1)-(8). Namely, transfer foil F is supplied on base substance P obtained by forming foil transferring face H on the base substance P which has been prepared through steps (1)-(4) which are not shown in FIGS. 1*a* to 1*c* and FIGS. 2*a* and 2*b*, and the supplied transfer foil F is brought in contact with the foil transferring face H. Under this state, heating is carried out to transfer the foil f2 on the foil transferring face H. Hereafter, steps (a)-(d) shown in FIGS. 1*a* to 1*c* and FIG. 2*a* will be specifically described.

FIG. 1*a* is a cross-sectional view of the base substance P prepared by forming a foil transferring face on sheet-like substrate P using the toner of the present invention. The method of forming foil transferring face H on base substance P through the manufacturing steps of above-mentioned (1)-(4) will be mentioned later.

Figure 1B:
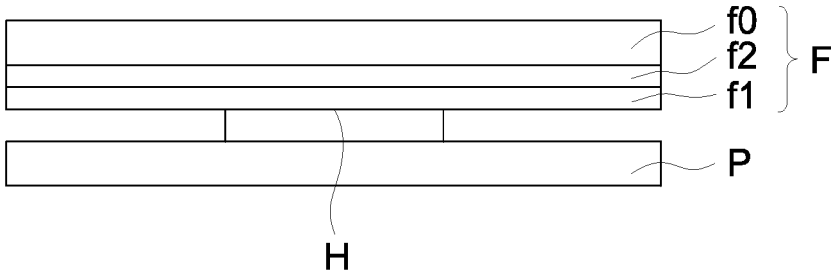

Next, FIG. 1*b* shows the state in which the transfer foil F which has, at least an adhesive layer f1 is supplied to the base substance P. The transfer foil F is provided so that the adhesive layer f1 is in contact with the foil transferring face H. At this time, it is considered that the adhesive layer f1 of the supplied transfer foil F is in contact with all over the base substance P. Accordingly, the adhesive layer f1 is in contact with the foil transferring face H which is formed on the base substance with a convexed form. It is expected that an adhesive condition is formed between the adhesive layer f1 of the transfer foil F and the foil transferring face H according to the effect of the aforementioned carboxyl group, on the foil transferring face H formed with the toner of the present invention. As one of the aspects of the present invention, a transfer foil F has at least an adhesive layer f1 and a foil layer f2 on a film f0 used as a substrate. A layer other than the adhesive layer f1 and the foil layer 2 is omitted here. A detailed explanation of the transfer foil F usable in the present invention will be given later.

Figure 1C:
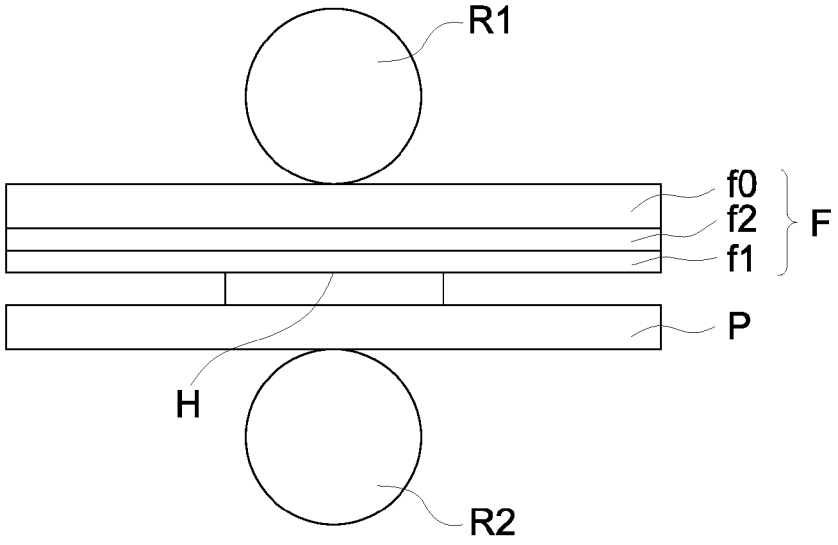

FIG. 1*c* shows a state in which the base substance P is passed between the heat roller R1 and the pressure roller R2 which are heating media while the transfer foil F is in contact with the base substance P, in which the adhesive layer f1 of the transfer foil F is in contact with the foil transferring face H on the base substance P while it is passed between the heat-pressure rollers R1 and R2 which are heating media. By passing through between the heat-pressure rollers R1 and R2, the adhesive layer f1 of the transfer foil F is melted, and the adhesive layer n is cooled to be hardened after passing. At this time, the adhesive layer f1 of a portion which is in contact with the foil transferring face H forms a firm adhesion state between the foil transferring faces H. The contact face pressure obtained by the heat-pressure rollers R1 and R2 is preferably 200-600 kPa. Thus, in the present invention, the transfer foil F forms an adhesion state between the foil transferring faces H through the adhesive layer f1 in contact with the foil transferring face H formed in a convexed state on the base substance P. Accordingly, it is possible to transfer the foil layer f2 in a shape faithful to the shape of the foil transferring face H from the transfer foil F.

Figure 2A:
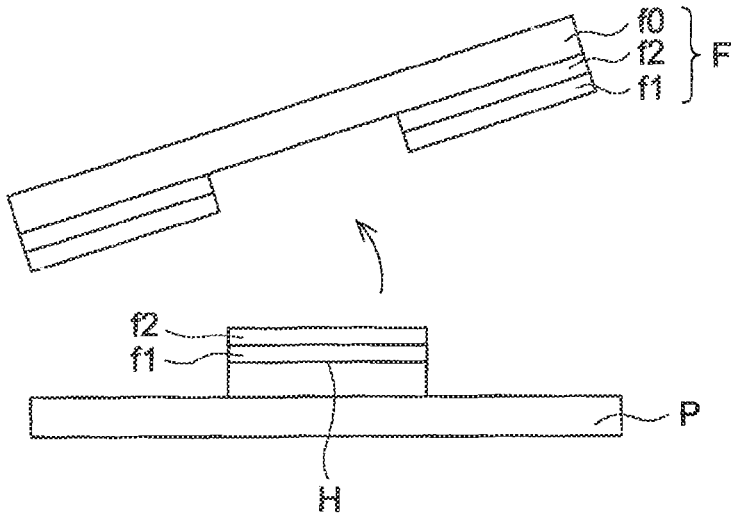
FIGS. 2*a* and 2*b* are schematic diagrams showing a procedure to transfer a foil on a foil transferring face formed on a base substance.
Figure 2B:
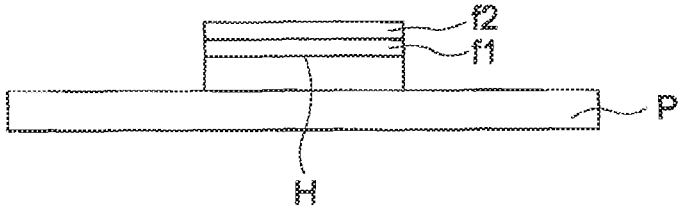

Next, FIG. 2*a* shows the state of removing the transfer foil F from the base substance P and, when the transfer foil F is removed, foil layer f2 is transferred together with the adhesive layer f1 only on the foil transferring face H on the base substance P. Here, using the foil transferring face forming toner of the present invention, it is possible to transfer foil layer f2 in a shape corresponding to the shape of the foil transferring face H, which enables to accurately transfer foil layer f2 of a prescribed shape without using a metal press while avoiding missing of the foil or burrs.

Therefore, according to the present invention, by using a foil transfer apparatus with an simple and compact structure without using a metal press, it is possible to conduct foil transfer of a prescribed shape free from missing of the foil and burrs, whereby it is possible to produce a product P having a high quality foil image with a simple foil transfer apparatus. Further, by employing the foil transferring face forming toner of the present invention, the foil layer f2 having a prescribed shape transferred on base substance P becomes easier to be compatible with the adhesive layer f1 due to the effect of the carboxyl group existing in the foil transferring face H, and the transferred foil becomes more difficult to be peeled. Accordingly, contribution to the improvement of the durability of the aesthetic appearance due to the foil transfer of the product P can also be acquired.

Next, an example of the foil transferring face formation devices which enables to form a foil transferring face on a base substance employing the foil transfer method of the present invention will be explained using FIG. 3. The foil transferring face formation device 1 in FIG. 3 enables to perform the steps (1) to (4) among steps (1) to (8), and it has a photoreceptor which forms an electrostatic latent image by light exposure. A foil transferring face corresponding to the electrostatic latent image is formed by supplying the foil transferring face forming toner of the present invention to the photoreceptor, followed by transferring the formed foil transferring face onto a base substance.

Figure 3:
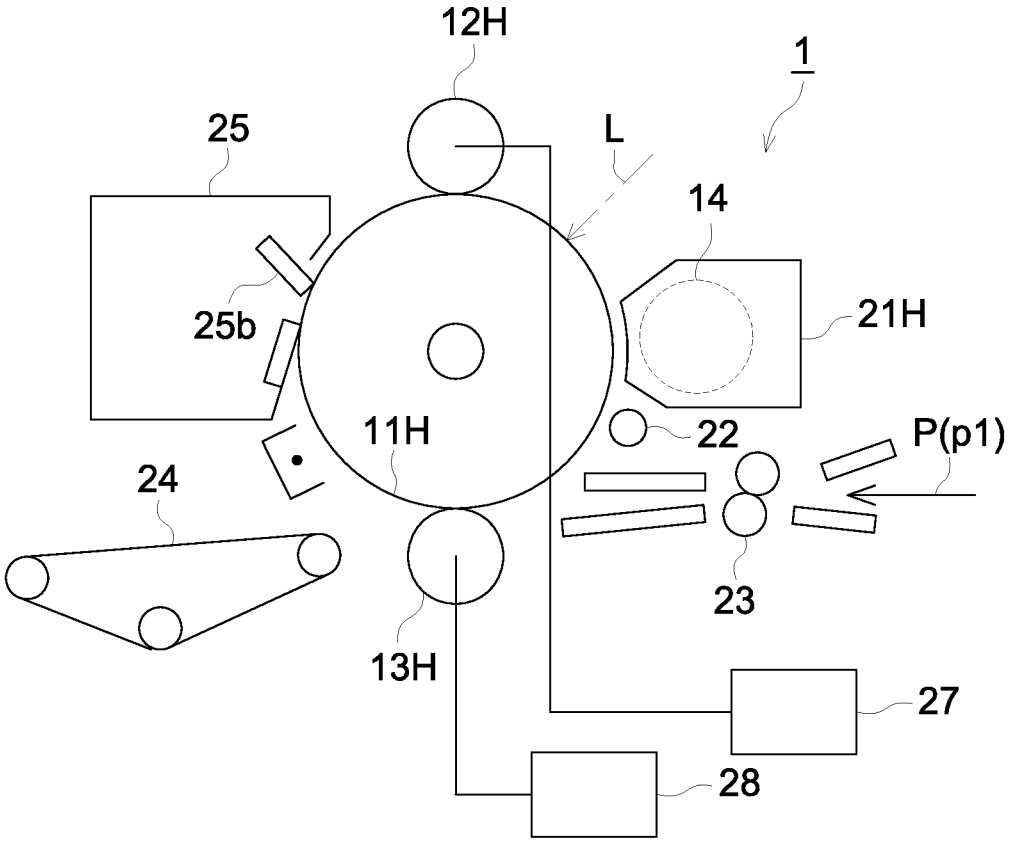
FIG. 3 is a schematic diagram of a foil transferring face formation device to form a foil transferring face via an electrostatic latent image method.

In the foil transferring face formation device 1 of FIG. 3, an electrostatic latent image is formed on the photoreceptor 11H charged with the charging roller 12H in the figure, when the photoreceptor is irradiated with the exposing light L. From the toner feeder 21H of a fail transferring face forming toner provided in the vicinity of the photoreceptor 11H, a foil transferring face forming toner is supplied to the electrostatic latent image formed on, the photoreceptor 11H to form a foil transferring face. At this time, the toner feed roller 14 built in the toner feeder 21H of a foil transferring face forming toner is rotated to supply the toner attached on the toner feed roller 14 to the photoreceptor 11H, whereby a foil transferring face is formed on the photoreceptor 11H.

Next, when the electric charge on Photoreceptor 11H is neutralized with the neutralizing lamp 22, the foil transferring face on the Photoreceptor 11H is transferred onto the substrate p1 which constitutes the base substance P in the transfer section where the Photoreceptor 11H and the transfer roller 13H are placed close to each other. The substrate p1 which is a sheet like material, typically a transfer paper, shown in FIG. 3 is conveyed from the paper cassette which is not illustrated to the transfer section by the conveying roller 23, where an electric charge of the reverse polarity with the polarity of the foil transferring face forming toner is given to the substrate p1 by the transfer roller 13H. The foil transferring face is transferred onto the substrate p1 from the photoreceptor 11H according to an electrostatic action of the electric charge of the reverse polarity given by the transfer roller 13H.

The substrate p1 on which the foil transferring face is transferred is conveyed to the fixing device which is not illustrated by the conveyance belt 24, after separated from the photoreceptor 11H. The fixing device has a fixing means, for example, a heating roller and a pressure roller, and melts the foil transferring face formed on the substrate p1 to fix the foil transferring face.

According to the aforementioned procedure, in the foil transferring face formation devise 1 shown in FIG. 3, an electrostatic latent image corresponding to the shape of the foil is formed on the photoreceptor 11H, a foil transferring face forming toner is supplied on the photoreceptor 11H to form a foil transferring face, and the foil transferring face formed on the photoreceptor 11H is transferred onto the substrate p1 which constitutes the base substance product P with the transfer roller 13H.

Figure 4:
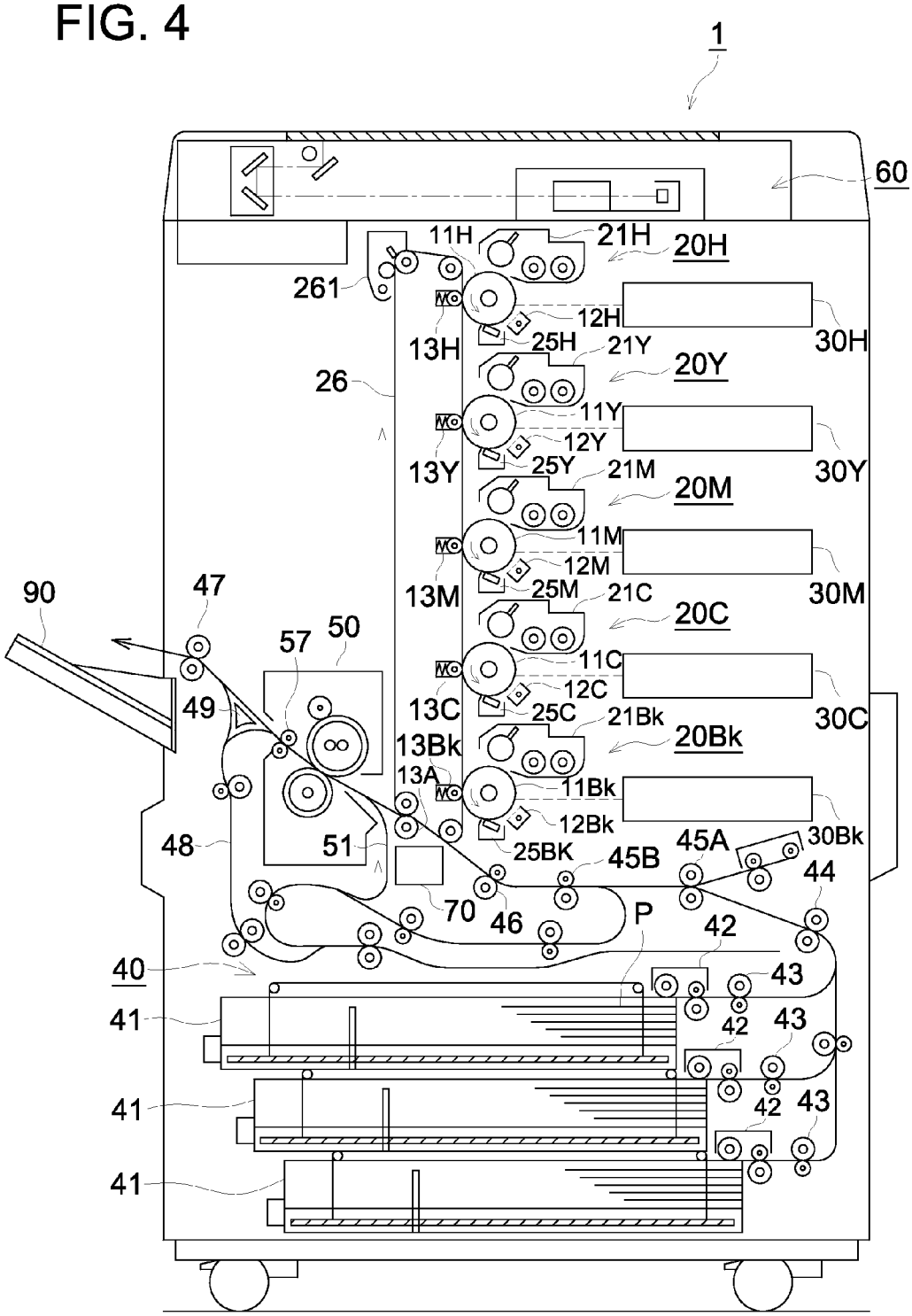
FIG. 4 is a cross-sectional diagram of a foil transferring face formation apparatus which simultaneously performs formation of a foil transferring face and full color image formation.

The charging roller 12H shown in the figure charges the photoreceptor 11H according to the following procedure. Namely, the charging roller 12H is applied with a bias voltage which is composed of a direct-current (DC) component and an alternating, current (AC) component from the power supply 27 to charge the photoreceptor drum 11H. The charging method used for the charging roller 12H shown in FIG. 3 is called a contact charging method, and, in the present invention, a non-contact charging method used in the device which will be explained later in FIG. 4 is also applicable to charge the photoreceptor besides the charging system shown in FIG. 3. The bias voltage impressed to the charging roller 12H is a superimposed voltage of, for example, a DC bias of ±500-1000V which is a direct current component, and an AC bias of 100 Hz-10 kHz and 200-3500V which is an alternating current component.

The transfer roller 13H in FIG. 3 is also impressed with a bias voltage containing both a direct current (DC) component and an alternating current (AC) component as well as the charging roller 12H, to transfer the foil transferring face formed on the photoreceptor 11H onto the substrate p1. A specific example of a bias voltage impressed to the transfer roller 13H includes a superimposed voltage of a DC bias of ±500-1000V which is a direct current component, and an AC bias of 100 Hz-10 kHz and 200-3500V which is an alternating current component, similarly to the specific example of a bias voltage impressed to the charging roller 1214.

The charging roller 12H and the transfer roller 13H may be driven by the photoreceptor 11H while being pressed onto the photoreceptor or may be driven by themselves. The pressing force of these rollers to the photoreceptor drum 11H is, for example, $9.8\times10^{-2}$-$9.8\times10^{-1}$ N/cm. The above pressing force of the rollers onto the photoreceptor 11H can be obtained, for example, by applying a force of 1 N-10 N to the ends of the charging roller 12H.

In addition, the residual toner on the photoreceptor 11H after transferring the foil transferring face to the substrate p1 is removed by the cleaning blade 25*b* provided in the cleaning device 25 to be ready for performing the next foil transferring face formation.

Further, in the present invention, it is also possible to transfer a foil having an image on a base substance having thereon a foil transferring face and further form a visible image on the base substance. The method of forming a visible image on the base substance is not specifically limited, however, examples of forming a visible image include well known image forming methods, for example, an electrophotographic method, a printing method, an ink jet method and a conventional silver-salt photographic method. For example, after forming a foil transferring face on a base substance and transferring a foil on the foil transferring face, a toner image can be formed via an electrophotographic method around the transferred foil. Or, it is also possible to form an image having a different type of hue by providing a color toner on the foil. According to these methods, a further luminosity expression can be given to a product having a transferred foil.

FIG. 4 is a cross-sectional configuration diagram of an foil transferring face forming device which is capable of forming a full color toner image via an electrophotographic method and forming a foil transferring face as shown in aforementioned FIG. 3. The image forming devices shown in FIG. 4 has a configuration similar to the foil transferring face forming device 1 shown in FIG. 3 and has a fixing devise 50 by which the formed foil transferring face H is heated and pressed to be hardened.

The foil transferring face forming device 1 has a structure similar to that of an electrophotographic image forming apparatus so called as, a "tandem type color image forming apparatus" and contains a foil transferring face forming unit 20H, a plurality of toner image forming units 20Y, 20M, 20C and 20Bk, a belt-like intermediate transfer belt 26, a sheet feeder 40 and a fixing device 50. Specifically, in the foil transferring face forming device 1 shown in FIG. 4, a transfer foil feed unit 70 is provided below the intermediate transfer belt 26, and a foil is transferred on the foil transferring face H by supplying a transfer foil on the substrate p1 on which a foil transferring face H is fixed by the fixing device 50, followed by passing the substrate p1 having thereon the transfer foil again through the fixing device 50.

Thus, in the foil transferring face forming device 1 shown in FIG. 4, a foil transferring face H is formed on a substrate p1 constituting a base substance P, and a foil is transferred on the obtained foil transferring face H. And, then, a full color image can be formed using a color toner on the substrate p1 on which a foil has been transferred. In the foil transferring face forming device 1 shown in FIG. 4, the transfer foil feed unit 70 is provided below the intermediate transfer belt 26, however, the position of the transfer foil feed unit is not specifically limited as far as foil transfer is capable by heating and pressing in the fixing devise 50, after supplying a transfer foil.

Figure 8:
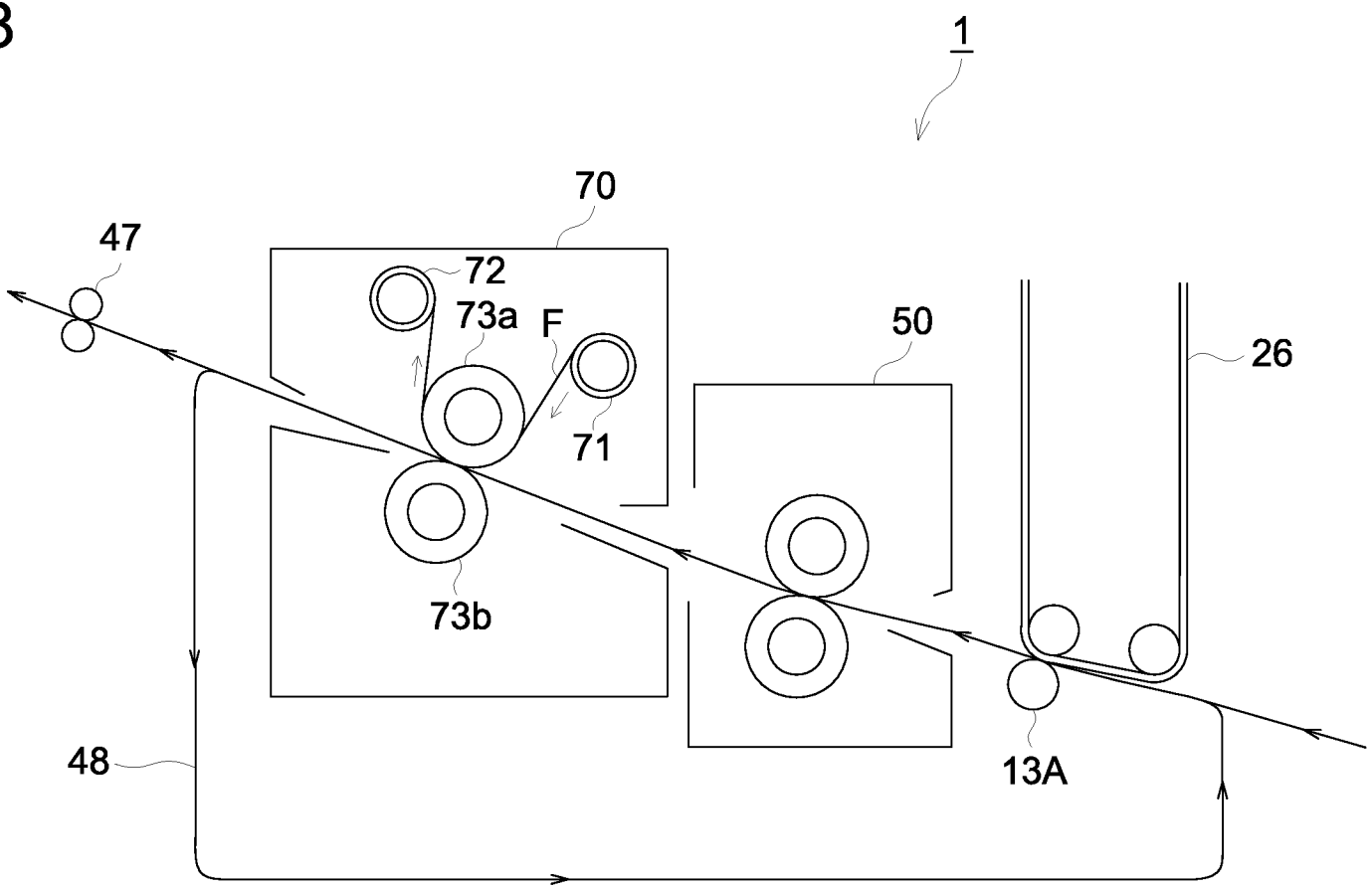
FIG. 8 is a schematic diagram showing an example of a configuration of an intermediate transfer roller, a fixing device, and a transfer foil feed member.

With respect to the configuration of the intermediate transfer belt 26, the fixing device 50, and the transfer foil feed unit 70, for example, a configuration shown in FIG. 8 may also be cited as a preferable example, in addition to the configuration shown in FIG. 8. In the foil transferring face formation apparatus 1 shown in FIG. 8, the intermediate transfer belt 26, the fixing device 50, and the transfer foil feed unit 70 are sequentially arranged. The arrow head in this figure represents the conveying direction of the substrate p1. The transfer foil feed unit 70 shown in FIG. 8 has a transfer foil supply roll 71, foil transfer rollers 73*a* and 73*b* and a transfer foil winding roller 72, in which a transfer foil F is provided from the transfer foil supply roll 71, and the spent transfer foil F after foil transfer is rolled up by the transfer foil winding roller 72. In FIG. 8, the foil transferring face formation unit 20H, the toner image formation units 20Y, 20M, 20C and 20Bk are omitted. FIG. 8 will, be described in detail later.

An image reading device 60 is installed in the upper part of the foil transferring face forming device 1. A manuscript placed on a manuscript holder is image-scanning-exposed to light emitted by an optical system of a manuscript image-scanning exposure device in the image reading device 60 to read the image in a line image sensor. The analog signals photoelectrically converted by the line image sensor are input to light exposure devices 30H, 30Y, 30M, 30C and 30Bk, after conducting analog processing, A/D conversion, a shading correction and image compression processing in control section.

In FIG. 4, in naming a component generically, the reference numerals in which alphabet subscript is omitted are used, and in pointing out discrete components, the reference numerals which is attached with the subscript of H (for foil transferring face), Y (yellow), M (magenta), C (cyan), and Bk (black) are used.

The foil transferring face forming toner supplier unit 21H which supplies the foil transferring face forming toner of the present invention, the yellow image forming unit 20Y which performs toner image formation of yellow color, the magenta image forming unit 20M which performs toner image formation of magenta color, the cyan image forming unit 20C which performs toner image formation of cyan color, black image forming unit 20Bk which performs toner image formation of black color each respectively have the following constitution. Namely, (1) drum-like photoreceptor 11 (11H, 11Y, 11M, 11C, 11Bk)
(2) charging electrode 12 (12H, 12Y, 12M, 12C, 12Bk)
(3) light exposure unit 30 (30H, 30Y, 30M, 30C, 30Bk)
(4) foil transferring face forming toner supplier unit 21H, and toner supplier unit 21 (21Y, 21M, 21C, 21Bk)
(5) cleaning unit 25 (25H, 25Y, 25M, 25C, 25Bk).

The photoreceptor 11 contains an organic photoreceptor in which a photoreceptor layer containing a resin in which an organic photoconductor is incorporated is formed on a peripheral surface of a drum shaped metal support, which is placed extending toward the width direction of the substrate p1 constituting the base substance P (a direction perpendicular to the paper sheet in FIG. 4). As a resin for the photoreceptor layer formation, a well-known resin for forming a photoreceptor layer such as polycarbonate is used. In the embodiment shown in FIG. 4, an example in which a drum shaped photoreceptor 11 is used, however, the photoreceptor is not limited thereto and a belt shaped photoreceptor may be used.

The foil transferring face forming toner supplier unit 21H includes a two-component developer containing the foil transferring face forming toner (T) of the present invention. Further, the developing units 21 each include respective two-component developer containing a carrier and, respectively, a yellow toner (Y), a magenta toner (M), a cyan toner (C) and a black toner (Bk). The two-component foil transferring face forming developer is constituted of a carrier having ferrite particles on which an insulating resin is coated and the foil transferring face forming toner of the present invention. The two-component developers each are constituted of; for example, a carrier having ferrite particles on which an insulating resin is coated, a well-known binder resin, a colorant such as a well-known pigment or carbon black, a charge control agent, silica, or titanium oxide.

As for a carrier, the average particle diameter is 10-50 μm and the saturation magnetization is 10-80 emu/g. The average particle diameter of the toner is 4-10 μm. The electrification characteristic of the toner used in the image forming device shown in FIG. 4 is preferably a negative electrification characteristic and the amount of average electric charge is preferably −20 to −60 μC/g. The mixing ratio of the toner and the carrier in each of the two-component developers and in the two-component foil transferring face forming developer is adjusted so that the content of the toner is 4-10% by mass.

The intermediate transfer belt 26 which is an intermediate transfer medium is rotatably supported by plural rollers. The intermediate transfer belt 26 is an endless belt exhibiting a volume resistance of preferably $10^6$-$10^{12}$ Ω·cm. The intermediate transfer belt 26 may be formed with a well-known resin, for example, polycarbonate (PC), polyimide (PI), polyamideimide (PAT), polyvinylidiene fluoride (PVDF), or a tetrafluoroethylene-ethylene copolymer (ETFE). The thickness of the intermediate transfer belt 26 is preferably 50-200 μm.

The foil transferring face H formed on the photoreceptor 11H with the toner supplied from foil transferring face forming toner supplier unit 21H is transferred onto the rotating intermediate transfer belt 26 with the primary transfer roller 13H (primary transfer). The foil transferring face H transferred onto the intermediate transfer belt 26 is then transferred onto a substrate p1 which is supplied by the sheet feeder 40 which will be described later. The substrate p1 on which the foil transferring face H is transferred is passed through a fixing device 50 which will be described later to fix the foil transferring face H.

The substrate p1 of which the foil transferring face H has been fixed is once conveyed through a discharge path having an eject roller 47, and then, through a conveyance path 48, conveyed to the transfer foil supplying path 51 where a transfer foil is supplied from the transfer foil supplier 70. Further, the substrate p1 supplied with the transfer foil is passed through the fixing device 50 again, while the transfer foil being supplied, to transfer a foil onto the foil transferring face H by heating and pressing in the fixing device 50.

The substrate p1 on which formation of the foil transferring face H and the transfer of the foil were thus performed is conveyed in front of the intermediate transfer roller 26 via the above-mentioned double-sided conveyance path 48, and, then, a toner image is formed. First, each color image formed on each of the photoreceptors 11Y, 11M, 11C, 11Bk, respectively, using each color toner supplied by each of toner supplier units 20Y, 20M, and 20C, respectively, is sequentially transferred onto intermediate transfer belt 26 employing each of primary transfer rollers 13Y, 13M, 13C, and 13Bk, respectively, whereby a combined full color image is formed. On the other hand, residual toners on the photoreceptor 11H from which the foil transferring face H was transferred and photoreceptors 11Y, 11M, 11C and 11Bk from which toner images were transferred are removed using cleaning units 25 (25H, 25Y, 25M, 25C and 25Bk), respectively.

The substrate p1 constituting the base substance P stored in storing member 41 (tray) in sheet feeder 40 is fed to first feeding member 42 and conveyed through feeding rollers 43, 44, 45A, 45B, and resist roller 46 (second feeding member) to secondary transfer roller 13A, where the foil transferring face H and the color image are transferred onto the substrate p1 (secondary transfer).

The three vertically arrayed storing members 41 in the lower portion of the foil transferring face forming device 1 were provided with the same number since these three members have almost the same structure. Also, the three vertically arrayed feeding members 42 were provided with the same number since the structures are almost the same. The storing members 41 and the feeding members 42 in all are named as a sheet feeder 40.

The foil transferring face H and the full color image transferred onto the substrate p1 constituting the base substance P are fixed on the substrate p1 by fixing unit 50 which hardens the foil transferring face H and the full color image by heating and pressing. The substrate p1 is conveyed between a pair of conveying rollers 57, discharged through discharge rollers 47, and placed on a discharge tray 90 which is outside of the image forming device.

After transferring the foil transferring face H and the full color toner image onto the substrate p1 using the secondary transfer roller 13A, followed by separating the substrate p1 by curvature separation, the residual toner on the intermediate transfer belt 26 is removed by a cleaning member 261 for the intermediate transfer belt.

When the foil transferring face H and the full color toner image are formed on both surfaces of the substrate p1 constituting the base substance P, a foil transferring face and a full color image are formed on the 1st page of the substrate p1, followed by melting them to harden, and the substrate p1 is bifurcated from the discharge path with the bifurcation plate 49. The substrate p1 is then introduced to a double-surface conveyance path 48 to convert the front side and the rear side, followed by conveying again to the feeding roller 45B. Also on the second surface, a foil transferring face H and a full color image are formed using the foil transferring face forming unit 20H and the image forming unit of each color 20Y, 20M, 20C and 20Bk, followed by being subjected to a heating/pressing treatment using the fixing unit 50, and discharging out of the image forming device using the discharging rollers 47. Thus, a full color toner image provided with a foil transferring face is formed on both surfaces of the base substance P.

In a foil transferring face forming device 1 in which an intermediate transfer belt 26, a fixing devise 50 and a transfer foil feed unit 70 are arranged as shown in FIG. 8, formation of a foil transferring face H, transfer of a foil and formation of a toner image are conducted, for example, according to the following procedure. Namely, (1) transferring the foil transferring face H formed on the intermediate transfer roller 26 onto a substrate p1 at the secondary transfer roller 13A, (2) fixing the foil transferring face H by passing the substrate p1 through the fixing device 50, (3) supplying a transfer foil F on the substrate p1 by the transfer foil feed unit 70, followed by conducting foil transfer, (4) conveying the substrate p1 transferred with a foil through the conveyance path 48 to the intermediate transfer belt 26, and transferring a full-color toner image onto the substrate p1, (5) fixing the full-color toner image by passing the substrate p1 through the fixing unit 50, and (6) passing the substrate p1 through the transfer foil feed unit 70, and discharging out of the apparatus through the eject roller 47.

According to the procedure described above, the foil transferring face forming device 1 shown in FIG. 4 or 8 enables: forming a foil transferring face H on a substrate p1 constituting a base substance P; transferring a foil onto the foil transferring face H thus formed; and forming a full-color image using color toners on the substrate p1 having thereon the transferred foil.

Figure 5:
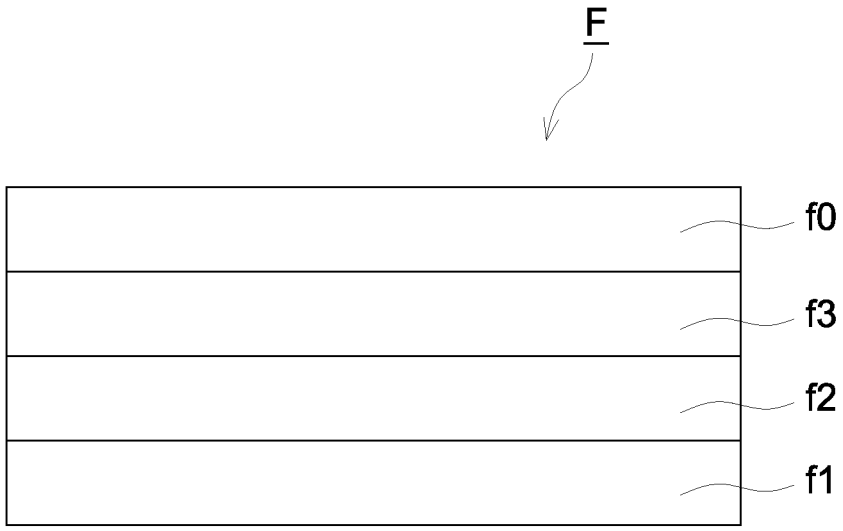
FIG. 5 is a schematic diagram showing a sectional structure of a transfer foil.

Next, the transfer foil which can be used in the present invention will be described using FIG. 5. FIG. 5 is a schematic diagram showing a sectional structure of one of the typical transfer foils usable in the present invention. The transfer foil F which can be used in the present invention has at least a film-like support f0 composed of, for example, a resin, a foil layer f2 containing, for example, a colorant or a metal, and an adhesive layer f1 containing an organic material which exhibits an adhesive property, and the foil layer f2 and the adhesive layer f1 transfer onto the base substance P. The adhesive layer f1 is formed on the outermost surface of the transfer foil F, and brought in direct contact with the surface of the base substance P to strongly adhere the foil layer f2 onto the surface of the base substance P, when transferred. Further, the transfer foil F shown in FIG. 5 has a release layer f3 between the support ft) and the foil layer f2. Hereafter, each layer of the support f0, foil layer f2 and adhesive layer f1 will be described.

First, the support f0 is a film or a sheet which is composed of, for example, a resin. As a material of the support f0, well-known resin materials, for example, a polyethylene terephthalate (PET) resin, a polyethylenenaphthalate (PEN) resin, a polypropylen (PP) resin, a polyether sulfone resin and a polyimide resin may be cited. Further, it is also possible to use materials such as paper other than these resin materials.

The support f0 may either have a single layer structure or a multi-layer structure. When a multi-layer structure is adopted in the support f0, it is preferable that the support f0 has a release layer f3, which can be used for adjusting peel resistance, on the outermost surface of the support f0 facing the foil layer f2.

Examples of a material for the release layer f3 include: a thermo-curable resin employing melamine or isocyanate as a hardener; and a UV curable resin or an electron beam curable resin containing an acrylic resin or an epoxy resin, which is added with a release agent known in the art.

The foil layer D contains, for example, a colorant or a metallic material, and, after it is transferred onto a base substance P, the foil layer f2 provides an aesthetic appearance. The foil layer f2 is expected to be smoothly released form the support f0 when it is transferred onto the base substance P, while the foil layer f2 is expected, after transferred, to exhibit durability since it forms the outermost surface of the base substance P. The foil layer f2 can be formed by applying a well-known resin which meets the above properties on the support f0 using a coater, for example, a gravure coater, a micro-gravure coater or a roll coater. Examples of such a well-known resin include an acrylic resin, a styrene resin and a melamine resin. It is also possible to add a well-known dye or pigment into the resin to provide a color.

When a foil of a finish exhibiting metallic gloss is formed, it is possible to provide the resin with a reflecting layer formed according to a well-known method using, for example, a metal. Examples of a metallic material which forms a reflecting layer include carriers such as aluminum, tin, silver, chromium, nickel and gold. Alloys, for example, a nickel chromium iron alloy, bronze and aluminum bronze are also usable in addition to the above metal carries. Examples of a method to form a reflecting layer using the above metallic materials include well-known methods such as a vacuum evaporation method, a sputtering method and an ion plating method, by which it is possible to form a reflecting layer having a thickness of 10 nm-100 nm. It is also possible to conduct a patterning process to provide a regular pattern using a well-known processing method, such as washing celite processing, etching processing, and laser beam machining, for example, to a reflecting layer.

The adhesive layer f1 contains a thermo sensitive adhesive agent so called a hot melt adhesive agent, which exhibits an adhesive property when heated. Examples of a thermo sensitive adhesive agent include well known thermoplastic resins usable for a hot melt adhesive agent such as an acrylic resin, a vinyl chloride-vinyl acetate copolymer, an epoxy resin and an ethylene-vinyl alcohol copolymer. The adhesive layer f1 can be formed by applying an aforementioned resin on a foil layer 12 using a coater, for example, a gravure coater, a micro-gravure coater or a roll coater.

EXAMPLES

The embodiments of the present invention will now be specifically explained using examples, however, the present invention is not limited thereto. In the following examples, the "part" or "parts" represents "mass part" or "mass parts", respectively.

1. Preparation of Foil Transferring Face Forming Toners 1-9

Nine kinds of toners for forming a foil transferring face (also referred to as "foil transferring face forming toners") were prepared via a polymerization method or a pulverization method as described below.

1-1 Preparation of Resin Particle Dispersion Liquids 1-5

(1) Preparation of Resin Particle Dispersion Liquid 1

In a reaction vessel equipped with an agitator, a temperature sensor, a condenser tube, and a nitrogen introduction equipment, 7.08 mass parts of an anionic surfactant (sodium dodecylbenzenesulfonates: SDS) was dissolved in 2760 mass parts of ion-exchanged water to obtain a surfactant aqueous solution. The temperature of the surfactant aqueous solution was raised to 80° C. under a nitrogen gas stream while agitating the surfactant aqueous solutions at a mixing rate of 230 rpm.

On the other hand, the following compounds were mixed and dissolved by heating the mixture at 80° C. to prepare a mixed monomer solution.

| | |
|---|---|
| Styrene | 130 mass parts |
| n-butyl acrylate | 50 mass parts |
| Methacrylic acid | 15 mass parts |
| Paraffin wax "HNP-57" (produced by NIPPON SEIRO Co., Ltd.) | 65 mass parts |
| n-octyl mercaptan | 3 mass parts |

Next, employing a mechanical dispersion apparatus having a circulatory pathway, the surfactant aqueous solution and the mixed monomer solution which were heated at 80° C. were mixed and dispersed to obtain a dispersion of emulsified particles having uniform diameters of dispersed particles.

Then, a solution prepared by dissolving 3.0 mass parts of potassium persulfate (KPS) in 200 mass parts of ion-exchange water was added, and heated at 80° C. while agitating for 2 hours to conduct a polymerization reaction, followed by cooling to 40° C. Thus a resin particle dispersion liquid was obtained.

Then, a solution prepared by dissolving 6.5 mass parts of potassium persulfate (KPS) in 240 mass parts of ion-exchange water was added to the above resin particle dispersion liquid. After 15 minutes, a mixed liquid containing the following compounds was added dropwise over 120 minutes to the above resin particle dispersion liquid at 80° C.

| | |
|---|---|
| Styrene | 380 mass parts |
| N-butyl acrylate | 120 mass parts |
| Methacrylic acid | 55 mass parts |
| n-octyl mercaptan | 9 mass parts |

After the dropwise addition was completed, a polymerization reaction was carried out by agitating for 60 minutes while heating, followed by cooling to 40° C. Thus resin particle dispersion liquid 1 containing resin particles 1 which have a structure having methacrylic acid units in the molecule was obtained.

(2) Preparation of Resin Particle Dispersion Liquid 2

Resin particle dispersion liquid 2 containing resin particles 2 which have a structure having itaconic acid units in the molecule was prepared in the same manner as the preparation of resin particle dispersion liquid 1 except that the methacrylic acid was changed to itaconic acid, in the first polymerization reaction, the above addition amount of potassium persulfate used as a polymerization initiator to the ion-exchanged water was changed to 4.0 mass parts and the reaction time was changed to 2.5 hours, and in the second polymerization reaction, the above addition amount of potassium persulfate used as a polymerization initiator to the ion-exchanged water was changed to 7.5 mass parts and the reaction time was changed to 90 minutes.

(3) Preparation of Resin Particle Dispersion Liquid 3

Resin particle dispersion liquid 3 containing resin particles 3 which have a structure having aconitic acid units in the molecule was prepared in the same manner as the preparation of resin particle dispersion liquid 1 except that the methacrylic acid was changed to aconitic acid, in the first polymerization reaction, the above addition amount of potassium persulfate used as a polymerization initiator to the ion-exchanged water was changed to 5.0 mass parts and the reaction time was changed to 3 hours, and in the second polymerization reaction, the above addition amount of potassium persulfate used as a polymerization initiator to the ion-exchanged water was changed to 8.5 mass parts and the reaction time was changed to 2 hours.

(4) Preparation of Resin Particle Dispersion Liquid 4

Resin particle dispersion liquid 4 containing resin particles 4 which have a structure having methacrylic acid units in the molecule was prepared in the same manner as the preparation of resin particle dispersion liquid 1 except that the mixed monomer solution used in the first polymerization reaction was changed to contain the following materials:

| | |
|---|---|
| Styrene | 135 mass parts |
| n-butyl acrylate | 55 mass parts |
| Methacrylic acid | 5 mass parts |
| Paraffin wax "HNP-57" (produced by NIPPON SEIRO Co., Ltd.) | 65 mass parts |
| n-octyl mercaptan | 3 mass parts, and |

the mixed monomer solution used in the second polymerization reaction was changed to contain the following materials:

| | |
|---|---|
| Styrene | 400 mass parts |
| N-butyl acrylate | 140 mass parts |
| Methacrylic acid | 15 mass parts |
| n-octyl mercaptan | 9 mass parts. |

the above addition amount of potassium persulfate used as a polymerization initiator to the ion-exchanged water was changed to 5.0 mass parts and the reaction time was changed to 3 hours, and in the second polymerization reaction, the above addition amount of potassium persulfate used as a polymerization initiator to the ion-exchanged water was changed to 8.5 mass parts and the reaction time was changed to 2 hours.

(5) Preparation of Resin Particle Dispersion Liquid 5

Resin particle dispersion liquid 5 containing resin particles 5 was prepared in the same manner as the preparation of resin particle dispersion liquid 1 except that the mixed monomer solution used in the first polymerization reaction was changed to contain the following materials:

| | |
|---|---|
| Styrene | 140 mass parts |
| n-butyl acrylate | 55 mass parts |
| Paraffin wax "HNP-57" (produced by NIPPON SEIRO Co., Ltd.) | 65 mass parts |
| n-octyl mercaptan | 3 mass parts, and |

the mixed monomer solution used in the second polymerization reaction was changed to contain the following materials:

| | |
|---|---|
| Styrene | 410 mass parts |
| n-butyl acrylate | 145 mass parts |
| n-octyl mercaptan | 9 mass parts. |

1-2 Preparation of Foil Transferring Face Forming Toner 1

(1) Preparation of Toner Parent Particles 1

In a reactions vessel equipped with an agitating equipment, a temperature sensor, a condenser tube, and a nitrogen introduction equipment,

| | |
|---|---|
| Resin particles 1 | 1080 mass parts (in terms of solid content) |
| Resin particles 2 | 120 mass parts (in terms of solid content) |
| Ion-exchanged water | 2000 mass parts |

were installed and agitated. After adjusting the temperature of the liquid at 30° C., the pH value of the liquid was adjusted by adding a 5 mol/l sodium hydroxide solution.

Subsequently, an aqueous solution prepared by dissolving 35 mass parts of magnesium chloride hexahydrate in 35 mass parts of ion-exchanged water was added over 10 minutes while agitating at 30° C. After 3 minutes, the temperature was started to raise, and the temperature was raised to 90° C. in 60 minutes. While keeping the temperature at 90° C., aggregation and fusion of the particles were continued. In this state, using MULTISIZER 3 (produced by BECKMAN COULTER), the particle diameter of the particles obtained by the aggregation and fusion was measured, and, when the volume median diameter of the particles increased to 5.5 mm, an aqueous solution obtained by dissolving 150 mass parts of sodium chloride in 600 mass parts of ion-exchanged water was added to stop the aggregation of the particles.

After aggregation was stopped, the temperature of the liquid was kept at 98° C., while agitating, for ripening. While ripening, the fusion was proceeded until the average circularity became 0.965 by measuring "FPIA2100 (produced by SYSMEX Corp.)". Thus toner parent particles 1 were formed.

Then, the liquid was cooled to 30° C., the pH value of the liquid was adjusted to 2 using hydrochloride, and agitation was stopped.

Toner parent particles 1 obtained via the above processes were subjected to solid-liquid separation using a basket centrifuge MARK III type number 60×40 (produced by MATSUMOTO MACHINE CO., Ltd.), whereby a wet cake of toner parent particles 1 was obtained.

This wet cake was washed using 45° C. ion-exchanged water until the electrical conductivity of the filtrate obtained by the basket centrifuge became 5 μS/cm. Then, the cake was moved to a flash jet dryer (produced by SEISHIN ENTERPRISE Co., Ltd.), and dried until the water content decreased to 0.5% by mass. Thus, toner parent particles 1 were obtained.

(2) External Additive Treatment

The following external additives were added to obtained toner parent particles 1, and the external additive treatment was carried out using a HENSCHEL MIXER produced by MITSUI MAKE KOGYO Co., Ltd., whereby foil transferring face forming toner 1 was obtained:

| | |
|---|---|
| Silica treated with hexamethyl silazane (an average primary particle diameter of 12 nm) | 1.0 mass part |
| Titanium dioxide treated with n-octylsilane (an average primary particle diameter of 20 nm) | 0.3 mass part. |

The external additive treatment using a HENSCHEL MIXER was carried out under the condition of, peripheral speed of the impeller: 35 m/second, treatment temperature: 35° C. and treatment duration: 15 minutes.

The content of carboxyl groups in above foil transferring face forming toner 1 was determined to be $3.0\times10^{-6}$ mol/g by using the aforementioned conductometric titration apparatus "ABU91 Autoburett and CDM80 Conductivity meter".

1-3. Preparation of Foil Transferring Face Forming Toners 2-7

(1) Production of Foil Transferring Face Forming Toner 2

The addition amounts of resin particles in the preparation of toner parent particles 1 in the preparation of foil transferring face forming toner 1 were changed as follows to prepare toner parent particles 2:

| | |
|---|---|
| Resin particles 1 | 960 mass parts (in terms of solid content) |
| Resin particles 2 | 240 mass parts (in terms of solid content). |

Foil transferring face forming toner 2 was prepared in the same manner as the preparation of foil transferring face forming toner 1 except that toner parent particles 2 were used instead of toner parent particles 1. The content of carboxyl groups in above foil transferring face forming toner 2 was determined to be $1.0\times10^{-5}$ mol/g by using the aforementioned conductometric titration apparatus.

(2) Production of Foil Transferring Face Forming Toner 3

The kinds and the addition amounts of resin particles in the preparation of toner parent particles 1 in the preparation of foil transferring face forming toner 1 were changed as follows to prepare toner parent particles 3:

| | |
|---|---|
| Resin particles 1 | 900 mass parts (in terms of solid content) |
| Resin particles 2 | 240 mass parts (in terms of solid content). |
| Resin particles 3 | 60 mass parts (in terms of solid content). |

Foil transferring face forming toner 3 was prepared in the same manner as the preparation of foil transferring face forming toner 1 except that toner parent particles 3 were used instead of toner parent particles 1. The content of carboxyl groups in above foil transferring face forming toner 3 was determined to be $3.0\times10^{-5}$ mol/g by using the aforementioned conductometric titration apparatus.

(3) Production of Foil Transferring Face Forming Toner 4

The kinds and the addition amounts of resin particles in the preparation of toner parent particles 1 in the preparation of foil transferring face forming toner 1 were changed as follows to prepare toner parent particles 4:

| | |
|---|---|
| Resin particles 1 | 840 mass parts (in terms of solid content) |
| Resin particles 2 | 240 mass parts (in terms of solid content). |
| Resin particles 3 | 120 mass parts (in terms of solid content). |

Foil transferring face forming toner 4 was prepared in the same manner as the preparation of foil transferring face forming toner 1 except that toner parent particles 4 were used instead of toner parent particles 1. The content of carboxyl groups in above foil transferring face forming toner 4 was determined to be $5.0\times10^{-5}$ mol/g by using the aforementioned conductometric titration apparatus.

(4) Production of Foil Transferring Face Forming Toner 5

The kinds and the addition amounts of resin particles in the preparation of toner parent particles 1 in the preparation of foil transferring face forming toner 1 were changed as follows to prepare toner parent particles 5:

| | |
|---|---|
| Resin particles 1 | 780 mass parts (in terms of solid content) |
| Resin particles 2 | 270 mass parts (in terms of solid content). |
| Resin particles 3 | 150 mass parts (in terms of solid content). |

Foil transferring face forming toner 5 was prepared in the same manner as the preparation of foil transferring face forming toner 1 except that toner parent particles 5 were used instead of toner parent particles 1. The content of carboxyl groups in above foil transferring face forming toner 5 was determined to be $5.5\times10^{-5}$ mol/g by using the aforementioned conductometric titration apparatus.

(5) Production of Foil Transferring Face Forming Toner 6

The kinds and the addition amounts of resin particles in the preparation of toner parent particles 1 in the preparation of foil transferring face forming toner 1 were changed as follows to prepare toner parent particles 6:

| | |
|---|---|
| Resin particles 4 | 1200 mass parts (in terms of solid content) |

Foil transferring face forming toner 6 was prepared in the same manner as the preparation of foil transferring face forming toner 1 except that toner parent particles 6 were used instead of toner parent particles 1. The content of carboxyl groups in above foil transferring face forming toner 6 was determined to be $5.0\times10^{-7}$ mol/g by using the aforementioned conductometric titration apparatus.

(6) Production of Foil Transferring Face Forming Toner 7

Foil transferring face forming toner 5 was tried to prepare in the same manner as the preparation of foil transferring face forming toner 1 except that the resin particles used in the preparation of foil transferring face fanning toner 1 were changed as follows, however, the diameter of the particles could not be controlled in the aggregation process of the resin particles, therefore, the preparation of foil transferring face forming toner 7 was unsuccessful:

| | |
|---|---|
| Resin particles 5 | 1200 mass parts (in terms of solid content). |

1-4. Preparation of Foil Transferring Face Forming Toners 8 and 9

(1) Preparation of Foil Transferring Face Forming Toner 8

After the following compounds were sufficiently mixed by Henschel Mixer, manufactured by Mitsui Miike Mining Co., Ltd., the mixture was melted and kneaded by a biaxial extruding kneader PCM-30, manufactured by Ikegai Corp., from which the taking out parts was detached, and then cooled.

| | |
|---|---|
| Vinyl resin (which was formed via a well-known polymerization method using styrene/n-butyl acrylate/methacrylic acid/itaconic acid (mass-ratio = 25:10:3:2)) | 100 mass parts |
| Paraffin wax "HNP-57" (produced by NIPPON SEIRO Co., Ltd.) | 8.7 mass parts |

The obtained kneaded material was cooled on a cooling belt and roughly pulverized by a feather mill, and further pulverized by a mechanical pulverizer TMK, manufactured by Kawasaki Heavy Industries Ltd., until the average particle diameter was made to 9 to 10 μm. Moreover the pulverized material was powdered and roughly classified by a jet pulverizer IDS, manufactured by Nippon Pneumatic Mfg. Co., Ltd., until the average particle diameter was made to 5.5 μm. Toner parent particles 8 having a volume median diameter of 5.5 μm was prepared from the above roughly classified powder by using a rotor type classifying apparatus (Teaplex type separator 100ATP manufactured by Hosokawa Micron Corp.).

The following external additives were added to the above prepared toner parent particle 8 and treated by Henschel Mixer, manufactured by Mitsui Miike Mining Co., Ltd., to prepare foil transferring face forming toner 8.

| | |
|---|---|
| Hexamethylsilazane-treated Silica (average primary particle diameter: 12 nm) | 1.0 mass part |
| n-Octylsilane-treated titanium dioxide (Average primary particle diameter: 20 nm) | 0.3 mass part |

The treatment by Henschel mixer was carried out for 15 minutes at a circumference speed of the stirring wing of 35 msec and a treatment temperature of 35° C.

The content of carboxyl groups in above foil transferring face forming toner 8 was determined to be $8.0\times10^{-6}$ mol/g by using the aforementioned conductometric titration apparatus.

(2) Preparation of Foil Transferring Face Forming Toner 9

Toner parent particles 9 was prepared in the same manner as the preparation of toner parent particles 8 except that the following vinyl resin was used instead of the vinyl resin used in the preparation of toner parent particles 8.

| | |
|---|---|
| Vinyl resin (which was formed via a well-known polymerization method using styrene/n-butyl acrylate (mass-ratio = 5:2)) | 100 mass parts |

Foil transferring face forming toner 9 was prepared by conduction the same external additive treatment as described in the preparation of foil transferring face forming toner 8 on toner parent particles 9. No carboxyl group was detected in above foil transferring face forming toner 9 even by using the aforementioned conductometric titration apparatus.

The production methods of toner parent particles, the kinds of monomers having carboxyl groups used for the resin preparation, carboxyl group contents of foil transferring face forming toners 1-9 prepared as described above are listed in following Table 1.

TABLE 1

| Foil transferring face forming toner No. | Manufacturing method | Resin particles No. | Carboxyl group: Monomer containing carboxyl group | Carboxyl group: Content (mol/g) | Remarks |
|---|---|---|---|---|---|
| 1 | Emulsion association method | 1, 2 | Methacrylic acid, Itaconic acid | $3.0\times10^{-6}$ | |
| 2 | Emulsion association method | 1, 2 | Methacrylic acid, Itaconic acid | $1.0\times10^{-5}$ | |
| 3 | Emulsion association method | 1, 2, 3 | Methacrylic acid, Itaconic acid, Aconitic acid | $3.0\times10^{-5}$ | |
| 4 | Emulsion association method | 1, 2, 3 | Methacrylic acid, Itaconic acid, Aconitic acid | $5.0\times10^{-5}$ | |
| 5 | Emulsion association method | 1, 2, 3 | Methacrylic acid, Itaconic acid, Aconitic acid | $5.5\times10^{-5}$ | |
| 6 | Emulsion association method | 4 | Methacrylic acid | $5.0\times10^{-7}$ | |

TABLE 1-continued

| Foil transferring face forming toner No. | Manufacturing method | Resin particles No. | Carboxyl group: Monomer containing carboxyl group | Carboxyl group: Content (mol/g) | Remarks |
|---|---|---|---|---|---|
| 7 | Emulsion association method | 5 | — | — | Toner could not be prepared |
| 8 | Pulverization method | — | Methacrylic acid, Itaconic acid | $8.0 \times 10^{-6}$ | |
| 9 | Pulverization method | — | — | — | |

2. Evaluation Experimentation 2-1. Preparation of Foil Transferring Face Forming Toner Developer A ferrite carrier having an average particle diameter of 40 μm covered with a methylmethacrylate resin was mixed with each of foil transferring face forming toners 1-9 so that the content of each toner is 6% by mass. Thus foil transferring face forming toner developers 1-9 which were two-component developers were prepared.

2-2. Evaluation Experimentation (1) Evaluation Conditions

Each of foil transferring face forming toner developers 1-9 was charged in the foil transferring face forming toner supplying member 21H of foil transferring face forming device 1 having the structure shown in FIG. 4, and a foil transferring face was formed on a commercially available image carrier "OK TOP COAT+(basis weight of 157 g/m$^2$, thickness of 131 μm)" produced by 031 PAPER Co., Ltd., which was the base substance of foil transferring. In foil transferring face forming device 1, foil transferring faces were formed by setting the supplying amount of the foil transferring face forming toner at 4 g/m$^2$.

The fixing speed of an image carrier in fixing device 50 was set at 230 mm/sec, polytetrafluoroethylene (PTFE) was used as a surface material of the heating roll, and the surface temperature of the heating roll was set at 135° C.

After forming a foil transferring face on an image carrier with each toner using aforementioned foil transferring face forming device 1, a foil was transferred on the foil transferring face formed on each image carrier using a commercially available transfer foil having the layer structure illustrated in FIG. 5, according to the procedure shown in FIGS. 1 and 2. "BL No. 2 gold 2.8" produced by MURATA KIMPAKU Co., Ltd. was used as the transfer foil.

Foil transfer was carried out according to the procedure shown in FIGS. 1 and 2 under the following conditions, namely, (a) Heating roll: a silicone rubber layer of a thickness of 3 mm was provided on an aluminum substrate of outer diameter of 100 mm with a thickness of 10 mm, having a surface temperature of 150° C.;

(b) Pressure roll: a silicone rubber layer of a thickness of 3 mm was provided on an aluminum substrate of outer diameter of 80 mm with a thickness of 10 mm, having a surface temperature of 100° C.;

(c) Heat source: a halogen lamp was provided in each inside of the heating roller and the pressure roll (each temperature was controlled using a thermistor), (d) Nip width between the heating roller and the pressure roll was 7 mm, (e) Image carrier conveyance speed: 73 mm/sec, (f) Image carrier: feeding a A3 sized image carrier along the longitudinal direction, and (g) Evaluation ambient: normal temperature normal relative humidity ambient (temperature of 20° C. and 50% RH).

Figure 6:
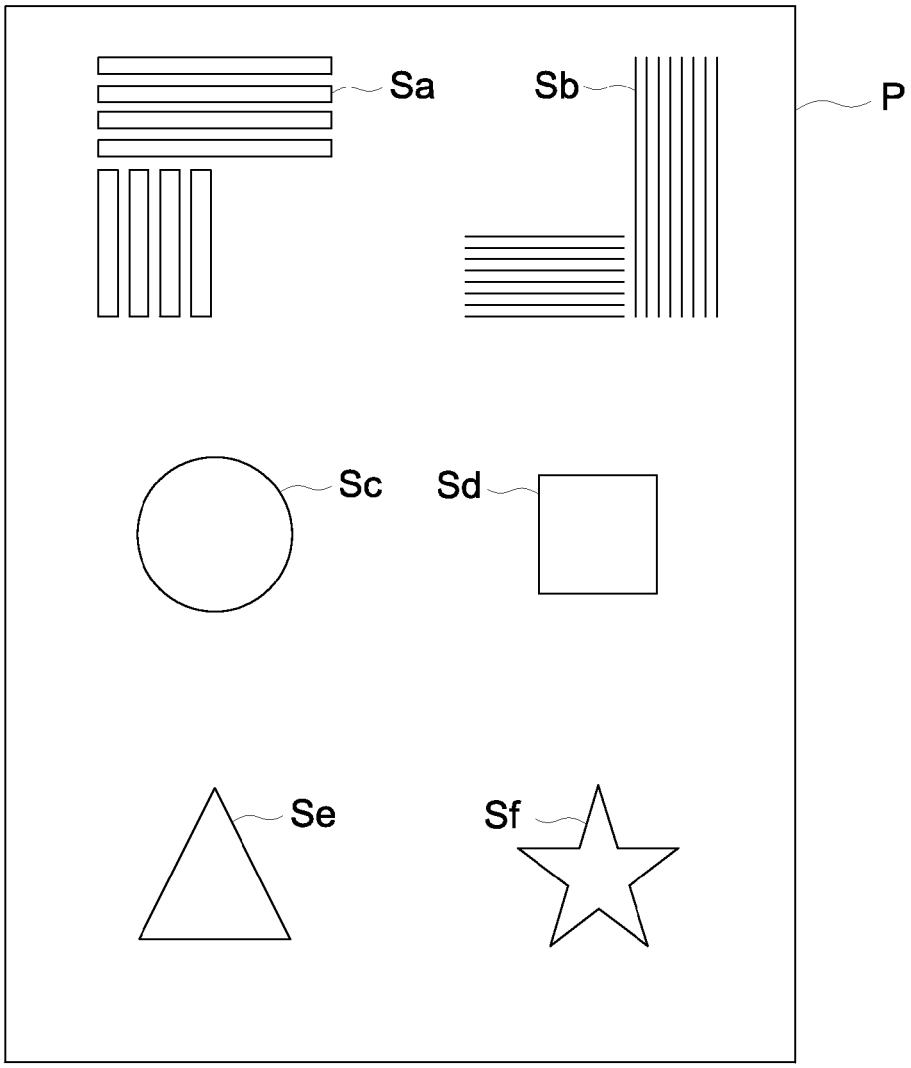
FIG. 6 is a schematic diagram of a foil image sample used for the evaluation in the examples.

Under the above conditions, six kinds of foil image samples shown in FIG. 6 were created on the image carrier. Sa and Sb in the figure were thin line images. In Sa, thin line images of a width of 2 mm were drawn vertically and horizontally at intervals of 1.5 mm width, and in Sb, tin line images of a width of 0.5 mm were drawn at intervals of 1 mm width. Further, Sc drew a circle, Sd drew a square, Se drew an equilateral triangle and Sf drew a star image.

(2) Evaluation Experimentation 1

On each of the foils formed on the specimen according to the aforementioned procedure, evaluation was carried out with respect to each of missing of the foil on the foil transferring face, occurrence of a burr, occurrence of foil transfer onto an unprescribed portion, reproducibility of thin line images and anti-peeling property. The evaluation of "missing of the foil on the foil transferring face" was carried out to examine whether the adhesive strength of the foil transferring face was too weak or not. The "occurrence of a burr" would be observed when there exist adhesion unevenness at an edge portion of the image, and it would not be observed when the adhesion is strong enough.

The evaluation of "occurrence of foil transfer onto an unprescribed portion" was carried out to examine the affection of water absorption onto the carboxyl groups to the charging capacity, and when the charging capacity is too low, a fog of the toner image is generated, and foil is also transferred onto the fog image. Further, the evaluation of "anti-peeling property" was carried out to examine the durability of the foil image according to the evaluation of the evaluation of the adhesive strength of the formed foil image.

Here, the specimen in which foils were formed employing foil transferring face forming toners 1-6, and 8 were designated as Examples 1-7, respectively, and the specimen in which foils were formed employing foil transferring face forming toners 7 and 9 were designated as Comparative Examples 1 and 2, respectively. Foil transferring face forming toner 7 could not be prepared since the particle diameter could not be controlled when resin particles 5 were aggregated, however, it was designated as Comparative Example 1, in the present experiments.

<Missing on Foil Transferring Face>

The foil images Sc through Sf formed on each specimen were observed visually and employing a loupe having a magnification of 10 times and presence of missing of the foil image on the foil transferring face was evaluated according to the following evaluation criteria. In the present invention, A and B were acceptable, while C was not acceptable.

A No missing of the foil image was observed even employing a loupe having a magnification of 10 times, B Minute missing of the foil image was observed employing the loupe, however, no problem was visually observed, and C Missing of the foil image was visually observed.

<Occurrence of Burr>

The foil images Sc through Sf formed on each specimen were observed visually and employing a loupe having a magnification of 10 times and occurrence of burr in the foil image on the foil transferring face was evaluated according to the following evaluation criteria. In the present invention, A and B were acceptable, while C was not acceptable.

A No occurrence of burr in the foil image was observed even employing a loupe having a magnification of 10 times, B Minute occurrence of burr in the foil image was observed employing the loupe, however, no problem was visually observed, and C Occurrence of burr in the foil image was visually observed.

<Occurrence of Foil Transfer Out of a Predetermined Region>

The area out of the predetermined region on each sample was observed visually and employing a loupe having a magnification of 10 times, and the occurrence of foil transfer out of a predetermined region was evaluated according to the following criteria. In the present invention, A and B were acceptable, while C was not acceptable.

A No occurrence of foil transfer out of a predetermined region was observed even employing a loupe having a magnification of 10 times, B Minute occurrence of foil transfer out of a predetermined region was observed employing the loupe, however, no problem was visually observed, and C Occurrence of foil transfer out of a predetermined region was visually observed.

<Fine-Line Reproduction>

The aforementioned two thin line images were observed visually and employing a loupe having a magnification of 10 times, and existence of excess foil between the thin lines and occurrence of missing on the thin lines were evaluated according to the following criteria. In the present invention, A and B were acceptable, while C was not acceptable.

A No existence of excess foil between the thin lines and no occurrence of missing on the thin lines was observed even employing a loupe having a magnification of 10 times, B Minute missing of 0.5 mm width thin lines was observed, however, there was no problem when visually observed, and no excess foil was observed between the thin lines, and C Existence of excess foil was visually observed between the thin lines.

<Peeling Resistance>

On the thin line image, equilateral triangle, square, and star formed on each sample, a sticking tape was adhered and then peeled by hand. The condition of each foil image was observed visually and employing a loupe having a magnification of 10 times, and evaluated according to the following criteria.

In this evaluation, "Scotch mending tape MP-18 (produced by SUMITOMO 3M, Limited)." was used.

A No minute exfoliation observable with the loupe having a magnification of 10 times was found, B Minute exfoliation observable by the loupe having a magnification of 10 times was found, however, it was judge to be no problem by visual observation, and C Exfoliation which was visually observable was found.

The above results were shown in Table 2. Table 2 also includes the results of the evaluation experiments (part 2).

TABLE 2

| | | Evaluation under normal temperature-normal humidity condition | | | | | Evaluation under high temperature-high humidity condition | | |
|---|---|---|---|---|---|---|---|---|---|
| | Foil transferring face forming toner No. | Missing of foil | Occurrence of burrs | Foil transfer out of prescribed area | Thin line reproduction | Peeling resistance | Amount of electrification (μC/g) | Foil transfer out of prescribed area | Remarks |
| Example 1 | 1 | A | A | A | A | A | 39 | A | |
| Example 2 | 2 | A | A | A | A | A | 32 | A | |
| Example 3 | 3 | A | A | A | A | A | 30 | A | |
| Example 4 | 4 | A | A | A | A | A | 27 | B | |
| Example 5 | 5 | A | A | B | A | A | 25 | B | |
| Example 6 | 6 | B | B | A | B | B | 42 | A | |
| Example 7 | 8 | A | A | A | A | A | 40 | A | |
| Comparative Example 1 | 7 | — | — | — | — | — | — | — | Toner could not be prepared |
| Comparative Example 2 | 9 | C | C | B | C | C | — | — | |

Normal temperature-normal humidity condition: temperature of 20° C., relative humidity of 55% RH High temperature-high humidity condition: temperature of 30° C., relative humidity of 80% RH As shown in Table 2, it was confirmed that an excellent adhesive force between the foil transferring face and the transferred foil was provided, and foil transfer without causing missing of the foil and burrs could be conducted in each of Examples 1-7 in which the foil images were formed using the foil transferring face forming toners each having the constitution of the present invention. Further, no deterioration of charging property of the toner was observed, which might be caused by the water absorbing property due to the existence of carboxyl groups, and each toner causes no fogging in the transferred foil nor existence of transferred foil out of the foil transferring face.

Further, each foil image formed on the image carrier was provided with an adequate adhesive force and was free from exfoliation from the image carrier. Also, it was confirmed that the toner having a carboxyl group content in the prescribed range exhibited an excellent thin line reproduction property. On the other hand, in Comparative Example 2 in which used was a toner which did not meet the constitution of the present invention, missing of foil was visually observed in the transferred foil and the transferred foil was exfoliated when it was rubbed, thus it was found that the adhesive force of the transferred foil was considerably lower when compared with those of Example 1-7. In Comparative Example 1, the evaluation described above could not be conducted, because the parent particles of the toner could not be obtained due the failure of diameter control of the particles in the preparation step of the toner.

(3) Evaluation Experiment (Part 2)

Next, the charging property of the foil transferring face forming toner under a high temperature-high humidity condition (temperature of 30° C. and relative humidity of 80%) was evaluated. There had been a doubt that, in the toner of the present invention, the water absorbing property due to the existence of carboxyl groups in the toner might affect the property of the toner under a high temperature-high humidity condition, because the binder resin of the toner of the present invention was formed by using a vinyl monomer having a carboxyl group in a side chain. Accordingly, the measurement of an amount of electrification of the toner under the above high temperature-high humidity condition was conducted after the foil transferring face forming toner was placed in the above high temperature-high humidity condition for 48 hours, and the foil transfer according to the above mentioned procedure was conducted to evaluate the existence of transferred foil out of the prescribed area which was caused by the fogging due to insufficient amount of charge. The evaluation of the existence of transferred foil out of the prescribed area was carried out according to the aforementioned procedure.

<Amount of Electrification of Toner>

Figure 7:
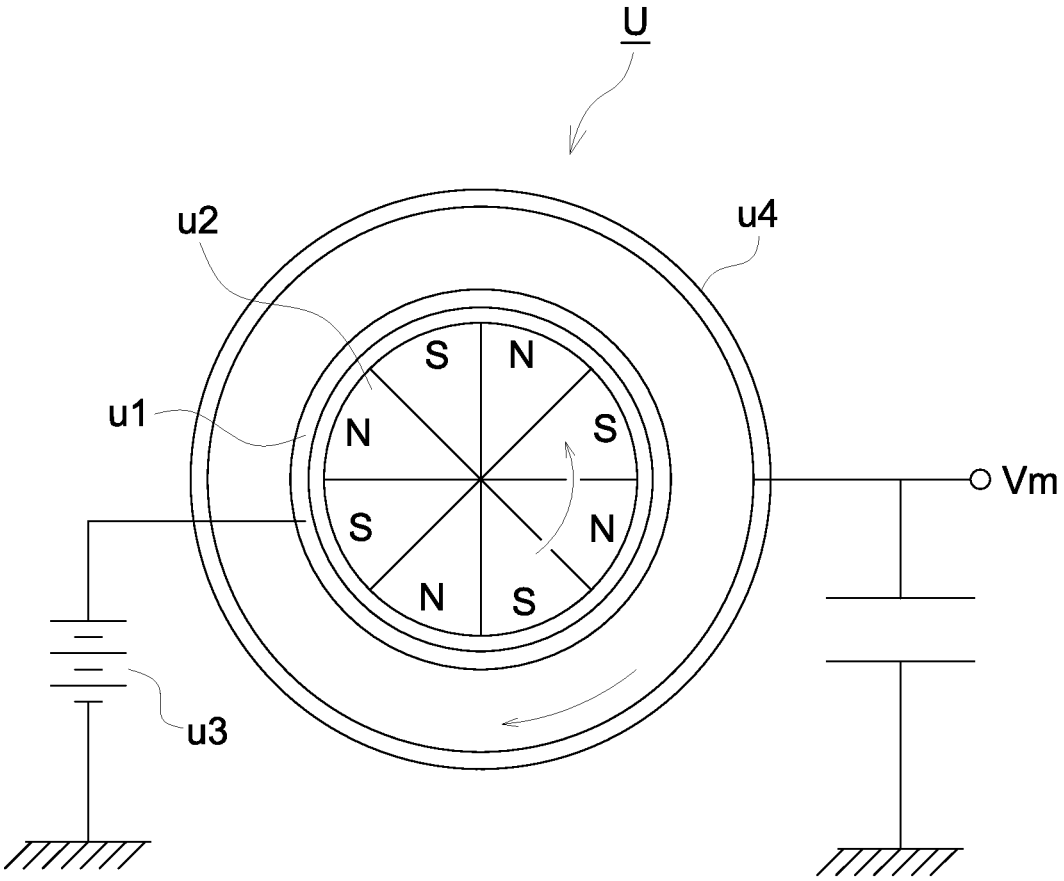
FIG. 7 is a schematic diagram of an apparatus which performs electrification quantity measurement of a toner.

The measurement of an amount of electrification of the foil transferring face forming toner was carried out using an electrification quantity measuring apparatus U shown in FIG. 7. First, 0.5 g of a foil transferring face forming toner developer weighed by a precision balance was uniformly supplied on all over the surface of the conductive sleeve u1 constituting the apparatus U. Next, a voltage of −3 kV was applied to the conductive sleeve u1 from the bias supply u3, and, simultaneously, the rotation frequency of the magnet roll u2 formed in the conductive sleeve u1 was set at 1000 rpm. After leaving the toner under this condition for 70 seconds, the foil transferring face forming toner was collected in a cylindrical electrode u4. After leaving the toner for 70 seconds, the potential Vm of the cylindrical electrode u4 was read to calculate the amount of electric charge, and the mass of the collected toner was weighed with a precision balance, whereby an average amount of electrification was obtained.

The absolute value of the amount of electrification of the foil transferring face forming toner of 25 μC/g or more was used as an index not to cause a fog due to the insufficient amount of electrification of the toner.

The results were given in above Table 2.

As shown in Table 2, it was confirmed that each of the foil transferring face forming toner meeting the constitution of the present invention exhibited an absolute value of the amount of electrification of 25 μC/g or more even after it was left under a high temperature-high humidity condition. Further, it was also confirmed that no excess foil out of the prescribed area due to fogging was observed even for a sample prepared under a high temperature-high humidity condition, thus stable foil transfer could be conducted.

What is claimed is:

1. A method of transferring a foil comprising the steps of:

(1) exposing a photoreceptor to form an electrostatic latent image;

(2) supplying a foil transferring face forming toner to a photoreceptor having thereon the electrostatic latent image to form a foil transferring face on the photoreceptor;

(3) transferring the foil transferring face formed on the photoreceptor onto a base substance;

(4) fixing the foil transferring face on the base substance;

(5) supplying a transfer foil having at least a foil and an adhesive layer on the base substance having the fixed foil transferring face;

(6) bringing the adhesive layer of the transfer foil in contact with the foil transferring face;

(7) heating the transfer foil and the foil transferring face while the adhesive layer of the transfer foil is in contact with the foil transferring face to adhere the foil onto the foil transferring face; and (8) removing the transfer foil from the base substance while leaving the foil adhered onto the foil transferring face, wherein the foil transferring face forming toner comprises at least a binder resin, wherein the binder resin comprises:

a polymer obtained by radically polymerizing at least a methacrylic acid and a polymer obtained by radically polymerizing at least a vinyl monomer which has two or more carboxyl groups; or a polymer obtained by radically polymerizing at least a methacrylic acid and a vinyl monomer which has two or more carboxyl groups.

2. The method of claim 1, wherein content of the carboxyl group comprised in the binder resin is $5.0\times10^{-7}$ mol/g to $5.0\times10^{-5}$ mol/g based on a mass of the binder resin.

3. The method of claim 1, wherein the content of the carboxyl group comprised in the binder resin is $5.0\times10^{-6}$ mol/g to $5.0\times10^{-5}$ mol/g based on a mass of the binder resin.

4. The method of claim 1, wherein an amount of the foil transferring face forming toner fixed on the base substance is 2.0 to 12.0 g/m$^2$.

5. The method of claim 1, wherein the step (7) is carried out using a heat roller and a pressure roller, wherein a contact face pressure obtained by using the heat roller and the pressure roller is 200 to 600 kPa.

6. A method of forming an image comprising the steps of:

preparing a base substance provided with a foil having an image, the foil having the image being transferred according to the method of claim 1; and forming a visible image using a toner according to an electrophotographic method on the base substance provided with the foil having the image to manufacture a product having both the foil having the image and the visible image.

* * * * *